US008261532B2

(12) United States Patent
Fukuda et al.

(10) Patent No.: US 8,261,532 B2
(45) Date of Patent: Sep. 11, 2012

(54) FUEL SUPPLY CONTROL METHOD APPLIED TO EXHAUST GAS CONTROL APPARATUS FOR INTERNAL COMBUSTION ENGINE AND EXHAUST GAS CONTROL APPARATUS TO WHICH THE METHOD IS APPLIED

(75) Inventors: Koichiro Fukuda, Sunto-gun (JP); Kingo Suyama, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 1069 days.

(21) Appl. No.: 11/597,356

(22) PCT Filed: May 19, 2005

(86) PCT No.: PCT/IB2005/001360

§ 371 (c)(1), (2), (4) Date: Dec. 22, 2006

(87) PCT Pub. No.: WO2005/116431

PCT Pub. Date: Dec. 8, 2005

(65) Prior Publication Data

US 2007/0214769 A1 Sep. 20, 2007

(30) Foreign Application Priority Data

May 24, 2004 (JP) ..... 2004-153770

(51) Int. Cl.
*F01N 3/00* (2006.01)

(52) U.S. Cl. ..... 60/285; 60/274; 60/297; 60/301

(58) Field of Classification Search ..... 60/285, 60/286, 295, 274, 276, 297, 301
See application file for complete search history.

(56) References Cited

U.S. PATENT DOCUMENTS

| | | | | |
|---|---|---|---|---|
| 6,393,834 | B1 | 5/2002 | Takaoka et al. | |
| 2004/0050037 | A1 | 3/2004 | Betta et al. | |
| 2004/0055285 | A1 * | 3/2004 | Rohr et al. | 60/295 |
| 2004/0187483 | A1 * | 9/2004 | Dalla Betta et al. | 60/286 |

FOREIGN PATENT DOCUMENTS

| | | |
|---|---|---|
| JP | A 11-148399 | 6/1999 |
| JP | A-11-148399 | 6/1999 |
| JP | A-2001-82137 | 3/2001 |
| JP | A 2001-82137 | 3/2001 |
| JP | A 2003-166415 | 6/2003 |
| JP | A-2003-166415 | 6/2003 |

* cited by examiner

*Primary Examiner* — Thomas Denion
*Assistant Examiner* — Diem Tran
(74) *Attorney, Agent, or Firm* — Oliff & Berridge, PLC

(57) ABSTRACT

In an exhaust gas control apparatus for an internal combustion engine (1) of the invention, including an exhaust gas control catalyst (8) which purifies exhaust gas released from the internal combustion engine (1), and a fuel supply valve (10) which supplies fuel to a portion upstream of the exhaust gas control catalyst (8), the fuel supply valve (10) is operated such that a cycle formed by combining a fuel supply period in which fuel is supplied from the fuel supply valve (10) and a fuel supply stopped period in which fuel is not supplied is repeatedly performed in order to control the temperature of the exhaust gas control catalyst (8) to the target temperature. The arrangement of the fuel supply period and the fuel supply stopped period is controlled such that the temperature of the exhaust gas control catalyst (8) at each of a starting point (P1) and an ending poring (P3) of each cycle is equal to the target temperature.

17 Claims, 16 Drawing Sheets

FUEL SUPPLY CONTROL METHOD APPLIED TO EXHAUST GAS CONTROL APPARATUS FOR INTERNAL COMBUSTION ENGINE AND EXHAUST GAS CONTROL APPARATUS TO WHICH THE METHOD IS APPLIED

BACKGROUND OF THE INVENTION

1. Field of the Invention

The invention relates to a fuel supply control method applied to an exhaust gas control apparatus for an internal combustion engine, which supplies fuel to a portion upstream of exhaust gas control means in order to control a temperature of the exhaust gas control means, for example, a NOx storage reduction catalyst to a target temperature. The invention also relates to an exhaust gas control apparatus to which the method is applied.

2. Description of the Related Art

In a NOx storage reduction catalyst used as exhaust gas control means for a lean-burn internal combustion engine (e.g., a diesel engine), a catalytic function thereof is reduced due to accumulation of sulfur oxides contained in exhaust gas. Therefore, when the NOx storage reduction catalyst is used, a recovery process, that is, so-called S recovery, needs to be periodically performed in order to decompose and remove the sulfur oxides accumulated in the catalyst thereby recovering the catalytic function. In the S recovery, a temperature of the catalyst (hereinafter, referred to as a "catalyst temperature" where appropriate) is increased to a target temperature (e.g., a temperature equal to or higher than 600° C.) that is higher than the upper limit of a temperature rage in a normal operating state, and an air-fuel ratio in a portion near the catalyst is maintained at the stoichiometric air-fuel ratio or a rich air-fuel ratio. The catalyst temperature is increased, for example, by adding fuel, as a reducing agent, to the exhaust gas. However, if a certain amount of fuel, which is required to control the catalyst temperature to the target temperature, is continuously supplied, a reductive reaction may occur continuously and therefore the catalyst temperature may increase excessively. In order to address this problem, for example, Japanese Patent Application Publication No. JP(A) 2003-166415 discloses an exhaust gas control apparatus which proceeds with the S recovery while suppressing overheating of the catalyst by alternately repeating a fuel supply mode and a fuel supply stopped mode instead of continuously supplying the amount of fuel that is required for the S recovery. Also, Japanese Patent Application Publication No. JP(A) 11-148399 and Japanese Patent Application Publication No. JP(A) 2001-82137 disclose technologies related to the invention.

In the exhaust gas control apparatus disclosed in each of the above-mentioned documents, a basic cycle of the fuel supply control is configured such that, after the entire amount of fuel that needs to be supplied during each cycle has been supplied, fuel supply is not performed during a period set based on the amount of supplied fuel. With such a configuration, the catalyst temperature fluctuates so as to be the lowest at each of the starting point and the ending point of each cycle, and so as to be the highest in the middle of the cycle. In this case, if the temperature is controlled such that the average temperature in each cycle becomes substantially equal to the target catalyst temperature, overheating of the catalyst and an insufficient increase in the catalyst temperature can be suppressed. However, as the length of the cycle becomes longer, the fluctuation range of the catalyst temperature in each cycle is increased. Accordingly, the catalyst temperature at each of the starting point and the ending point of the cycle also fluctuates based on the length of the cycle. Accordingly, when the cycles whose lengths are different from each other are alternately performed, the catalyst temperature at the starting point of the cycle performed later may fluctuate due to the effect of the catalyst temperature at the ending point of the cycle performed earlier. As a result, the catalyst temperature in the cycle performed later may deviate from the target temperature, and therefore overheating of the catalyst or an insufficient increase in the catalyst temperature may occur.

SUMMARY OF THE INVENTION

It is an object of the invention to provide a fuel supply control method for an exhaust gas control apparatus for an internal combustion engine, for suppressing deviation of a temperature of exhaust gas control means, for example, a NOx storage reduction catalyst from a target temperature, thereby preventing overheating of the exhaust gas control means and an insufficient increase in the temperature of the exhaust gas control means, and to provide an exhaust gas control apparatus to which the method is applied.

A fuel supply control method according to the invention is applied to an exhaust gas control apparatus for an internal combustion engine, which includes exhaust gas control means for purifying exhaust gas released from an internal combustion engine, and fuel supply means for supplying fuel to a portion upstream of the exhaust gas control means. In the fuel gas control method, the fuel supply means is operated such that the temperature of the exhaust gas control means is controlled to a target temperature. More particularly, when the fuel supply means is operated such that a cycle formed by combining a fuel supply period in which fuel is supplied from the fuel supply means and a fuel supply stopped period in which the fuel is not supplied is repeatedly performed, an arrangement of the fuel supply period and the fuel supply stopped period in each cycle is controlled such that the temperature of the exhaust gas control means at each of the starting point and the ending point of each cycle is equal to the target temperature.

With such a configuration, the temperature of the exhaust gas control means at each of the starting point and the ending point of each cycle is equal to the target temperature regardless of the length of the cycle. Therefore, even when the cycles whose lengths are different from each other are performed in combination, the temperature of the exhaust gas control means fluctuates in a fluctuation range such that the center value of the fluctuation range becomes substantially equal to the target temperature. It is therefore possible to prevent deviation of the temperature of the exhaust gas control means from the target temperature. It is also possible to suppress overheating of the exhaust gas control means and an insufficient increase of the temperature of the exhaust gas control means.

In the above-mentioned control method, the fuel supply means may be operated such that one of the fuel supply period and the fuel supply stopped period is divided into two periods and the other of the fuel supply period and the fuel supply stopped period is set between the two periods obtained by the division.

With such a configuration, the temperature of the exhaust gas control means fluctuates in the fluctuation range such that the center value of the fluctuation range becomes substantially equal to the target temperature. It is therefore possible to make the temperature of the exhaust gas control means at each of the starting point and the ending point of each cycle equal to the target temperature. It is also possible to make the center value of the fluctuation range, in which the temperature of the exhaust gas control means fluctuates, equal to the target temperature.

A exhaust gas control apparatus according to the invention, including exhaust gas control means provided in an exhaust passage of an internal combustion engine; fuel supply means for supplying fuel to a portion upstream of the exhaust gas control means; and fuel supply control means for operating the fuel supply means such that a cycle formed by combining a fuel supply period in which fuel is supplied from the fuel supply means and a fuel supply stopped period in which fuel is not supplied is repeatedly performed in order to control a temperature of the exhaust gas control means to a target temperature, is characterized in that the fuel supply control means includes temperature-based required fuel supply amount calculating means for calculating a fuel supply amount that is required to control the temperature of the exhaust gas control means to the target temperature; estimated fuel supply amount calculating means for calculating a fuel supply amount that is required to maintain an air-fuel ratio in the exhaust gas control means at a target air-fuel ratio during a predetermined period; fuel supply stopped period calculating means for calculating a length of the cycle based on the fuel supply amount calculated by the temperature-based required fuel supply amount calculating means and the fuel supply amount calculated by the estimated fuel supply amount calculating means, and for calculating a length of the fuel supply stopped period in the cycle by subtracting a length of the predetermined period, as a length of the fuel supply period, from the calculated length of the cycle; and fuel supply timing control means for controlling whether fuel supply by the fuel supply means can be performed in each cycle such that a half of the calculated fuel supply stopped period is set, as a pre-supply fuel supply stopped period, before the fuel supply period.

With such a configuration, the length of each cycle is calculated based on the fuel supply amount required to control the temperature of the exhaust gas control means to the target temperature and the fuel supply amount required to maintain the air-fuel ratio in the exhaust gas control means to the predetermined target air-fuel ratio. It is therefore possible to set the length of the fuel supply stopped period in each cycle such that the center value of the catalyst temperature in the cycle becomes equal to the target temperature, by supplying the amount of fuel required to maintain the air-fuel ratio in the exhaust gas control means at the target air-fuel ratio while offsetting an increase in the catalyst temperature due to fuel supply in the fuel supply period. By setting a half of the fuel supply stopped period, as a pre-supply fuel supply stopped period, before the fuel supply period, it is possible to make the temperature at each of the starting point and the ending point of the cycle equal to the target temperature.

In the exhaust gas control apparatus, the fuel supply control means may further include fuel supply stopped period correcting means for correcting a length of the pre-supply fuel supply stopped period based on a change in a calculation result obtained by the estimated fuel supply amount calculating means or the fuel supply stopped period calculating means in the pre-supply fuel supply stopped period.

The fuel supply amount in each cycle fluctuates based on a change in, for example, an engine load in the fuel supply period. Therefore, even when the length of the pre-supply fuel supply stopped period is set based on the fuel supply amount estimated in the pre-supply fuel supply stopped period, if the actual fuel supply amount is deviated from the estimated fuel supply amount, an error may occur in the length of the pre-supply fuel supply stopped period. A sign of a load change in the fuel supply period may be observed even in the pre-supply fuel supply stopped period. In this case, a change in the fuel supply amount in the fuel supply period can be estimated based on the tendency of the change in the estimated fuel supply amount in the pre-supply fuel supply stopped period or the length of the fuel supply stopped period calculated based on the estimated fuel supply amount. With the above-mentioned configuration, the length of the pre-supply fuel supply stopped period is corrected. It is therefore possible to adjust the length of the pre-supply fuel supply stopped period such that a change in the fuel supply amount in the fuel supply period can be dealt with in advance.

In the exhaust gas control apparatus, the fuel supply control means may further include fuel supply period correcting means for changing the fuel supply period from the predetermined period such that an amount of fuel actually supplied during the fuel supply period is equal to the fuel supply amount calculated by the estimated fuel supply amount calculating means in the pre-supply fuel supply stopped period.

With such a configuration, even when a factor, for example, a change in the engine load, that changes the fuel supply amount occurs in the fuel supply period, the length of the fuel supply period is changed based on the length of the pre-supply fuel supply stopped period. Therefore, the fuel supply amount in the fuel supply period is controlled so as to be equal to the fuel supply amount estimated in the pre-supply fuel supply stopped period. For example, when the fuel supply amount in the fuel supply period reaches the estimated fuel supply amount, the fuel supply period is completed. It is therefore possible to prevent the actual fuel supply amount from exceeding the fuel supply amount corresponding to the length of the pre-supply fuel supply stopped period. Meanwhile, when the fuel supply amount in the fuel supply period has not reached the estimated fuel supply amount even if the fuel supply period is continued for a predetermined period, the fuel supply period is extended and the recovery process for the catalyst can proceed.

In the above-mentioned exhaust gas control apparatus, the fuel supply control means may further include temperature maintaining fuel supply control means for determining whether an operating state of the internal combustion engine is appropriate for a recovery process for the exhaust gas control means that is performed by supplying fuel; for prohibiting fuel supply that is performed by the fuel supply means in order to maintain the temperature of the exhaust gas control means, when determining that the operating state is not appropriate for the recovery process in the pre-supply fuel supply stopped period; and for permitting fuel supply for maintaining the temperature of the exhaust gas control means after the pre-supply fuel supply stopped period is completed.

With such a configuration, fuel supply for maintaining the temperature of the catalyst is not performed until the pre-supply fuel supply stopped period is completed even if the operating state of the internal combustion engine deviates from the operating state appropriate for the recovery process for the catalyst in the pre-supply fuel supply stopped period. It is therefore possible to prevent an increase in the catalyst temperature in the pre-supply fuel supply stopped period, thereby preventing an increase in the period until the fuel supply period. As a result, the recovery process can be started earlier. Also, if the pre-supply fuel supply stopped period is completed when the operating state appropriate for the recovery process has not been realized, the fuel supply for maintaining the temperature is permitted. It is therefore possible to prevent the situation in which the catalyst temperature is decreased more necessary.

Preferably, the exhaust gas control means is a NOx storage reduction catalyst.

A fuel supply control apparatus according to another aspect of the invention includes exhaust gas control means provided in an exhaust passage of an internal combustion engine; fuel supply means for supplying fuel to a portion upstream of the exhaust gas control means; and fuel supply control means for operating the fuel supply means such that a cycle formed by combining a fuel supply period in which fuel is supplied from the fuel supply means and a fuel supply stopped period in which fuel is not supplied is repeatedly performed in order to control a temperature of the exhaust gas control means to a target temperature. In the fuel supply control apparatus, the fuel supply control means includes temperature-based required fuel supply amount calculating means for calculating a fuel supply amount that is required to control the temperature of the exhaust gas control means to the target temperature; estimated fuel supply amount calculating means for calculating a fuel supply amount that is required to maintain an air-fuel ratio in the exhaust gas control means at a target air-fuel ratio during a predetermined period; fuel supply stopped period calculating means for calculating a length of the cycle based on the fuel supply amount calculated by the temperature-based required fuel supply amount calculating means and the fuel supply amount calculated by the estimated fuel supply amount calculating means, and for calculating a length of the fuel supply stopped period in the cycle by subtracting a length of the predetermined period, as a length of the fuel supply period, from the calculated length of the cycle; and fuel supply timing control means for controlling whether fuel supply by the fuel supply means can be performed in each cycle such that a half of the fuel supply period is set, as a pre-supply-stop fuel supply period, before the fuel supply stopped period.

Preferably, the exhaust gas control means is a NOx storage reduction catalyst.

BRIEF DESCRIPTION OF THE DRAWINGS

The above-mentioned embodiment and other embodiments, objects, features, advantages, technical and industrial significance of this invention will be better understood by reading the following detailed description of the exemplary embodiments of the invention, when considered in connection with the accompanying drawings, in which.

DETAILED DESCRIPTION OF THE EXEMPLARY EMBODIMENTS

In the following description, the present invention will be described in more detail in terms of exemplary embodiments.

Figure 1:
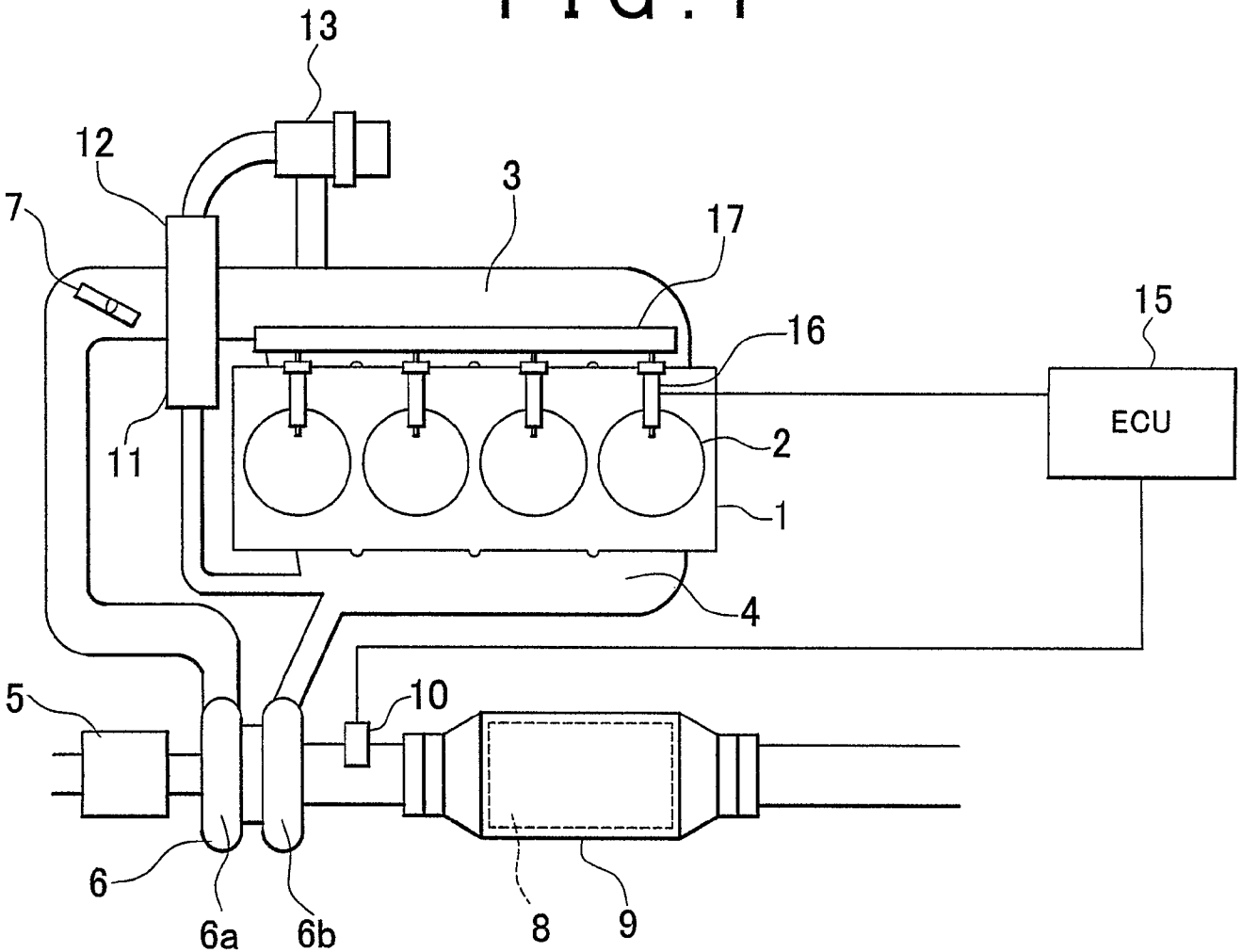
FIG. 1 is a view showing a case in which the invention is applied a diesel engine.

FIG. 1 shows a case in which the invention is applied to a diesel engine 1 serving as an internal combustion engine. The engine 1 is mounted in a vehicle as a power source for running. An intake passage 3 and an exhaust passage 4 are connected to each of cylinders 2 included in the engine 1. The intake passage 3 is provided with an air filter 5 for filtering intake air, a compressor 6*a* of a turbocharger 6, and a throttle valve 7 for adjusting an intake air amount. The exhaust passage 4 is provided with a turbine 6*b* of the turbocharger 6. An exhaust gas control unit 9 including a NOx storage reduction catalyst (hereinafter, simply referred to as a "catalyst") 8 and a fuel supply valve 10, which supplies fuel, as a reducing agent, to a portion upstream of the catalyst 8, are provided in the exhaust passage 4 at positions downstream of the turbine 6*b*. An EGR passage 11 permits communication between the exhaust passage 4 and the intake passage 3. The EGR passage 1 is provided with an EGR cooler 12 and an EGR valve 13.

The fuel supply valve 10 is provided in order to supply fuel to a portion upstream of the catalyst 8 thereby generating a reduction atmosphere which is necessary to discharge NOx stored in the catalyst 8 and to recover the sulfur component removing ability of the catalyst 8 ("hereinafter, referred to as "perform S recovery of the catalyst 8"). A fuel supply operation of the fuel supply valve 10 is controlled by an engine control unit (ECU) 15. The ECU 15 is a known computer unit which controls an operating state of the engine 1 by operating various devices such as fuel injection valves 16 for injecting fuel to respective cylinders 2, and a pressure regulator valve of a common rail 17 which stores fuel pressure to be supplied to the fuel injection valves 16. The ECU 15 controls a fuel injection operation of the fuel injection valves 16 such that an air-fuel ratio, that is, a mass ratio of the air taken in the engine 1 to the fuel supplied from the fuel injection valves 16 is controlled to be a lean air-fuel which is leaner than the stoichiometric air-fuel ratio. Also, the ECU 15 serves as fuel supply control means according to the invention by performing routines shown in FIGS. 4 and 5. These routines will be described later in detail. Although there are various other elements controlled by the ECU 15, the elements are not shown in the figures.

Figure 2A:
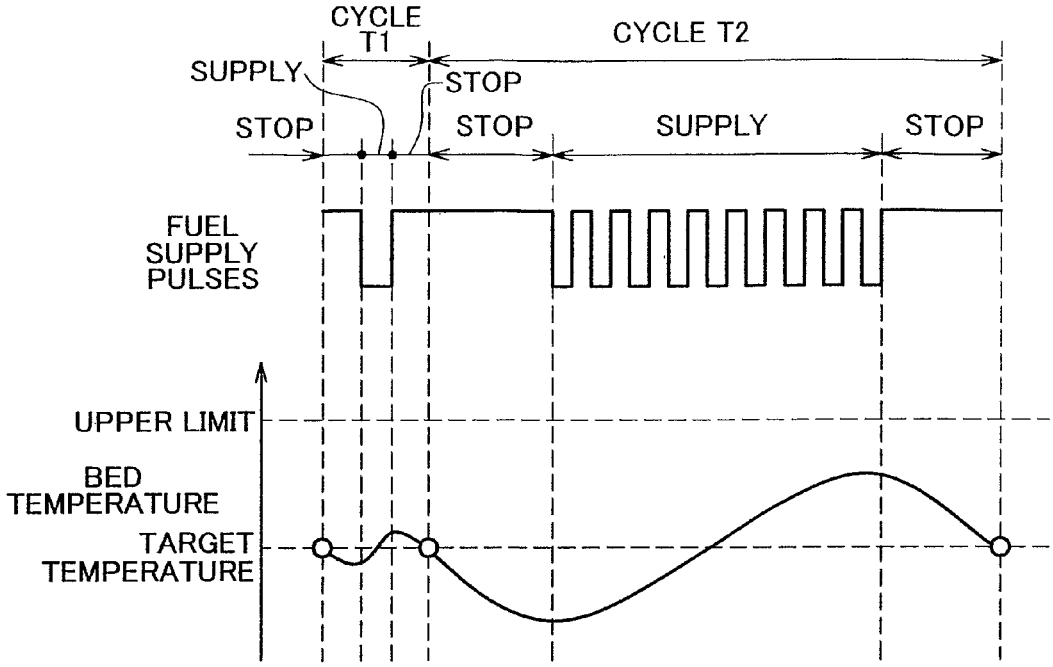
FIG. 2A is a view showing a relationship between fuel supply pulses of a fuel supply valve and a catalyst temperature (bed temperature) according to an example of the invention.
Figure 2B:
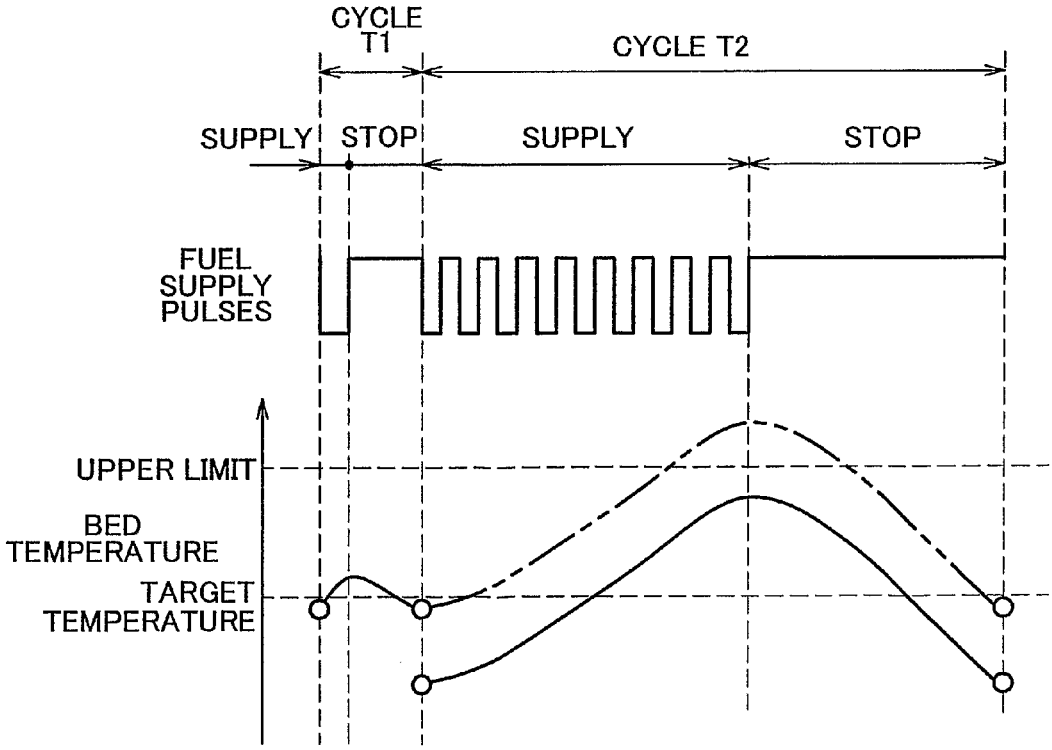
FIG. 2B is a view showing a relationship between fuel supply pulses of a fuel supply valve and a catalyst temperature (bed temperature) according to a comparative example.

Next, a description will be made concerning the fuel supply control performed by the ECU 15 when a temperature of the catalyst 8 is controlled to a target temperature in the S recovery. FIG. 2A shows a relationship between fuel supply pulses of the fuel supply valve 10 and the temperature (bed temperature) of the catalyst 8 in a simple example of the fuel supply control according to the invention. FIG. 2B shows this relationship in a comparative example. In each of these examples, the fuel supply control is performed by alternately performing cycles T1 and T2 whose lengths are different from each other (T1<T2) The fuel supply valve 10 supplies fuel in a pulsed manner. In the cycle T1, fuel is supplied during only one pulse. In the cycle T2, fuel is supplied during multiple pulses formed successively. In the cycle T2, a period in which the pulses are formed successively corresponds to a fuel supply period. A length of the fuel supply period in each of the cycles T1 and T2 is set to a value required to control the bed temperature to the target temperature in the S recovery. The length of the fuel supply period in the cycle T1 is appropriately set based on an operating state of the engine 1 in the cycle T1, and the length of the fuel supply period in the cycle T2 is appropriately set based on the operating state of the engine 1 in the cycle T2. A length of the fuel supply stopped period is set such that the bed temperature at the starting point is equal to the bed temperature at the ending point in each cycle. Namely, the fuel supply stopped period is set such that the bed temperature at the starting point is equal to the bed temperature at the ending point in one cycle.

A comparative example shown in FIG. 2B will be described. In this comparative example, a fuel supply period is set at the beginning of each of the cycles T1 and T2, and a fuel supply stopped period set based on the fuel supply period is set after the fuel supply period without being divided into two or more fuel supply stopped periods. In this case, the bed temperature becomes the lowest at each of the starting point and the ending point of each cycle, since the bed temperature increases in the fuel supply period and the increased bed temperature decreases in the fuel supply stopped period. Meanwhile, a fluctuation range of the bed temperature in each of the cycles T1 and T2 changes based on the length of the cycle. As the length of the cycle increases, the fluctuation range also increases. Therefore, as shown by solid lines in FIG. 2(B), the bed temperature at each of the starting point and the ending point of each of the cycles T1 and T2 needs to be changed based on the length of the cycle, in order to control the bed temperature such that the average temperature in each of the cycles T1 and T2 becomes equal to the target temperature. However, the bed temperature at the starting point of each cycle is equal to the bed temperature at the ending point of the last cycle. Accordingly, when the cycle T2 is performed immediately after the cycle T1, the bed temperature at the starting point of the cycle T2 becomes higher than a predetermined bed temperature due to the effect of the bed temperature at the ending point of the cycle T1 performed immediately before the cycle T2. As a result, as shown by an imaginary line in FIG. 2B, the bed temperature in the cycle T2 becomes higher than the target bed temperature. Accordingly, the highest bed temperature exceeds the upper limit of an permissible range depending on the fluctuation range in the cycle T2, resulting in occurrence of overheating of the catalyst 8.

On the other hand, in the example shown in FIG. 2A, each of the cycles T1 and T2 is configured such that a fuel supply stopped period in which fuel is not supplied, a fuel supply period in which fuel is supplied, and another fuel supply stopped period are set in this order. A length of a pre-supply fuel supply stopped period is equal to a length of a post-supply fuel supply stopped period. Namely, in each of the cycles T1 and T2, the fuel supply stopped period is equally divided into two fuel supply stopped periods, and the fuel supply period is set between these two fuel supply stopped periods. Also, in each of the cycles T1 and T2, the bed temperature at each of the starting point and the ending point is equal to the target temperature. The first half fuel supply stopped period corresponds to the pre-supply fuel supply stopped period.

With such a configuration, in each of the cycles T1 and T2, the bed temperature fluctuates in the fluctuation range such that the center value of the fluctuation range becomes substantially equal to the target temperature. As a result, the average bed temperature in each of the cycles T1 and T2 becomes equal to the target temperature. Since the bed temperature at each of the starting point and the ending point is equal to the target temperature in each of the cycles T1 and T2, even if the cycles T1 and T2 whose lengths are different from each other are performed in combination, the bed temperature is controlled such that the center value of the fluctuation range becomes substantially equal to the target temperature. Accordingly, the problem shown in FIG. 2B does not occur. It is therefore possible to suppress deviation of the bed temperature from the target temperature.

Figure 3:
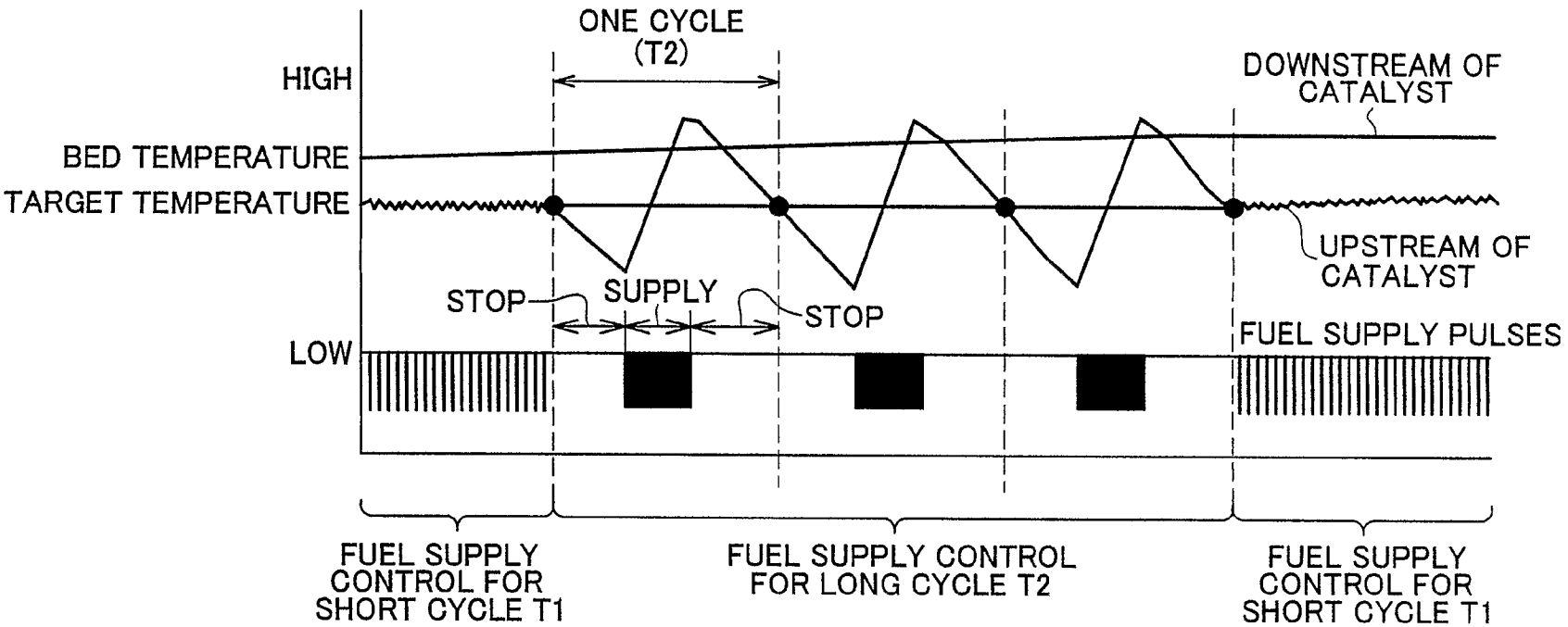
FIG. 3 is a view showing a more concrete example of an arrangement of a fuel supply period and a fuel supply stopped period according to the invention.

FIG. 3 shows fluctuation in the bed temperature in each of a portion upstream of the catalyst 8 and a portion downstream of the catalyst 8 in the case where the cycle T2 having a longer length performed successively three times while the cycle T1 having a shorter length is repeatedly performed. When the fuel supply control is performed by using the cycles whose lengths are different from each other in combination, the fluctuation range of the bed temperature at the portion upstream of the catalyst 8 changes based on the length of the cycle. Note that the center value of the fluctuation range is controlled to be a value near the target temperature.

A fuel supply timing control routine performed by the ECU 15 will be described with reference to FIGS. 4 to 6. FIG. 6 is used for supplementary description of the control performed according to the routine in FIG. 4. Note that the same reference terms as those in FIG. 4 are used in FIG. 6, each reference term indicating a value obtained in the routine in FIG. 4.

Figure 4:
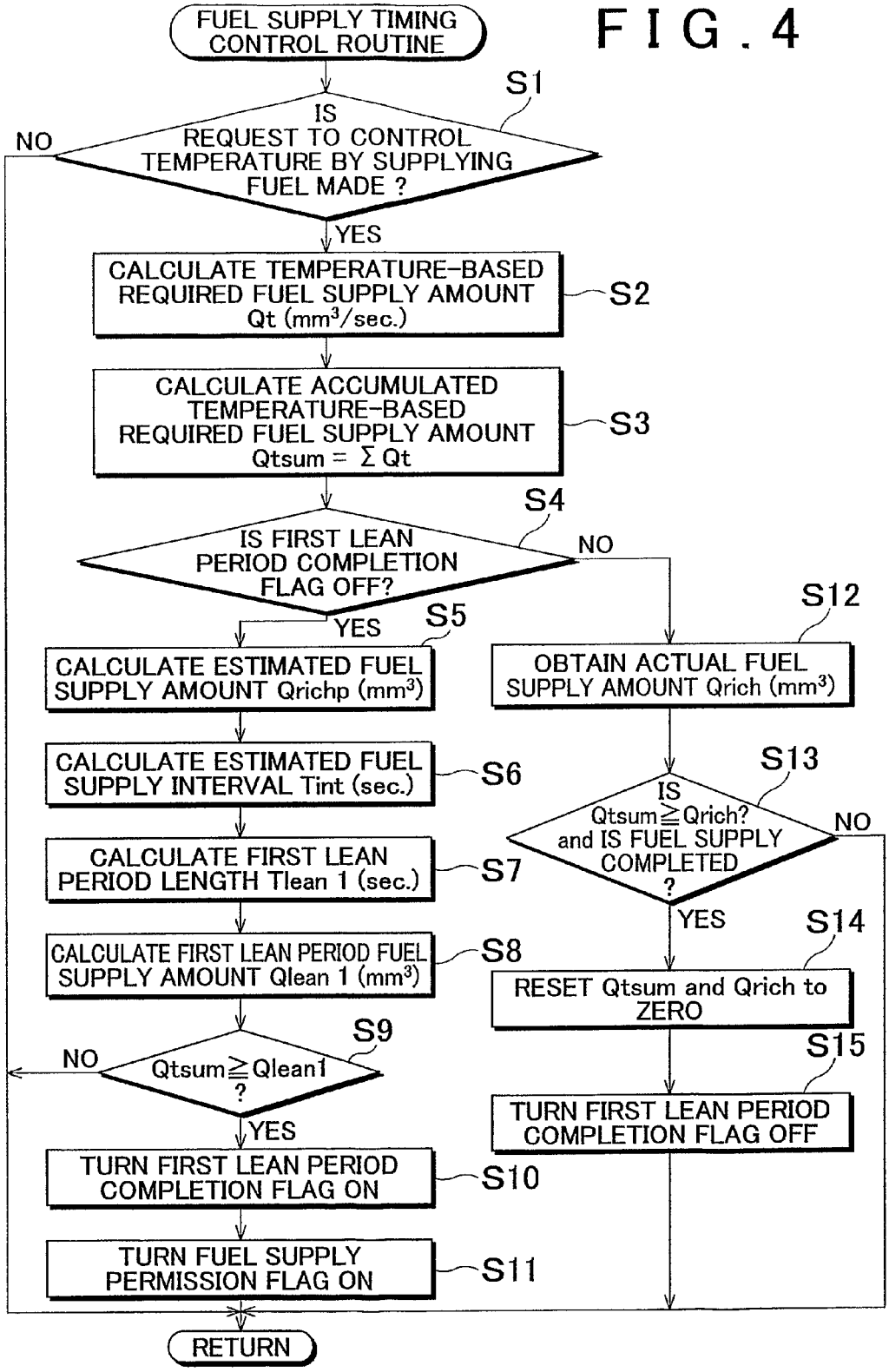
FIG. 4 is a flowchart showing a fuel supply timing control routine in a first embodiment of the invention.

The fuel supply timing control routine in FIG. 4 is repeatedly performed at predetermined intervals during an operation of the engine 1.

In step S1, it is determined whether a request to control the temperature of the catalyst 8 by supplying fuel from the fuel supply valve 10 has been made. This request is made according to another routine performed by the ECU 15, when the temperature of the catalyst 8 needs to be controlled to the target temperature in the S recovery by supplying fuel. When it is determined that the request to control the temperature has not been made, the present fuel supply timing control routine ends. On the other hand, when it is determined that the request to control the temperature has been made, step S2 is then performed.

In step S2, a temperature-based required fuel supply amount Qt (mm3/sec.) is calculated. The temperature-based required fuel supply amount Qt is an amount of fuel supplied per unit time, which is necessary to control the temperature of the catalyst 8 to the target temperature. The temperature-based required fuel supply amount Qt is set based on parameters such as the target temperature of the catalyst 8, an exhaust gas temperature which affects the temperature of the catalyst 8, a flow rate of the exhaust gas, and a heat capacity of the catalyst 8, obtained when step S2 is performed. At least one of these values based on which the temperature-based required fuel supply amount Qt is set fluctuates according to the operating state of the engine 1. Accordingly, the fuel supply amount calculated in step S2 also fluctuates according to the operating state of the engine 1 when the routine is performed. In step S2, the ECU 15 serves as temperature-based required fuel supply amount calculating means in the invention.

In step 3, an accumulated temperature-based required fuel supply amount Qtsum ($mm^3$) is calculated. The accumulated temperature-based required fuel supply amount Qtsum is obtained by accumulating the temperature-based required fuel supply amounts Qt from the starting point to the ending point of one cycle of the fuel supply control. As shown in FIG. 6, the accumulated temperature-based required fuel supply amount Qtsum gradually increases from a starting point P1 of the cycle. When the accumulated temperature-based required fuel supply amount Qtsum at an ending point P3 of one cycle is equal to an amount of fuel Qrich actually supplied during the cycle (hereinafter, referred to as an "actual fuel supply amount Qrich"), the appropriate amount of fuel, which is required to control the temperature of the catalyst 8 to the target temperature, has been supplied during the cycle.

After the accumulated temperature-based required fuel supply amount Qtsum is obtained, step S4 is then performed. In step S4, it is determined whether a first lean period completion flag, which is used for determining whether a first lean period in FIG. 6 has been completed, is OFF, that is, whether the flag indicates that the first lean period has been uncompleted. The first lean period corresponds to the first half fuel supply stopped period (the pre-supply fuel supply stopped period) in FIG. 2A. When fuel is not supplied from the fuel supply valve 10, the air-fuel ratio at a portion near the catalyst 8 is controlled to be a lean air-fuel ratio. Accordingly, the period in which fuel is not supplied is referred to as the lean period.

When it is determined in step S4 that the first lean period completion flag is OFF, step S5 is then performed in which an estimated fuel supply amount Qrichp ($mm^3$) is calculated. The estimated fuel supply amount Qrichp is obtained according to the following equation.

$$Qrichp=[(\text{new air amount}/\text{target air-fuel ratio})-\text{in-cylinder fuel injection amount}]\times\text{length of rich period}$$

In this case, the new air amount is an amount of air ($mm^3$) taken in the intake passage 3 from the outside of the engine 1. The target air-fuel ratio is a target value of the air-fuel ratio at a portion near the catalyst 8 during the S recovery. The in-cylinder fuel injection amount is an amount of fuel ($mm^3$) injected from the fuel injection valve 16 to the cylinder 2. Also, the rich period is a fuel supply period (sec.) in one cycle, which is uniquely set based on a load of the engine 1, temperature increasing performance of the catalyst 8, and a request to discharge sulfur components. Namely, the rich period is set based on for how many seconds the fuel should be supplied in one cycle. The rich period corresponds to the length of the fuel supply period in FIG. 2(A). Based on the relationship among the new air amount, the target air-fuel ratio, the in-cylinder fuel injection amount, and the length of the rich period, the estimated fuel supply amount Qrichp is obtained as the fuel supply amount that is necessary to maintain the air-fuel ratio in a portion near the catalyst 8 at the target air-fuel ratio during only the rich period. When the load of the engine 1 changes in the rich period, the in-cylinder fuel injection amount also changes. Note that the fuel supply amount Qrichp obtained in step S5 is an estimated value.

After the estimated fuel supply amount Qrichp is obtained in step S5, step S6 is performed. In step S6, an estimated fuel supply interval Tint (sec.) is calculated according to the following equation.

$$Tint=Qrichp/Qt$$

Namely, the estimated fuel supply interval Tint is a period necessary for the fuel supply amount to reach the estimated fuel supply amount Qrichp in the case where fuel supply is continued at the fuel supply amount Qt per unit time that is calculated in step S2. The estimated fuel supply interval Tint corresponds to the length of one cycle. Then, step S7 is performed in which a length of the first lean period Tlean 1 (hereinafter, referred to as a "first lean period length Tlean 1") (sec.) is calculated according to the following equation.

$$Tlean1=(Tint-\text{rich period})/2$$

According to this equation, the length of the entire fuel supply stopped period in one cycle is obtained by subtracting the length of the fuel supply period, that is, the length of the rich period used in the calculation in step 5 from the length Tint of one cycle. Then, the first lean period length Tlean 1 is obtained by dividing the length of the entire fuel supply stopped period by two.

In step S8, a first lean period fuel supply amount Qlean 1 ($mm^3$) is calculated according to the following equation by multiplying the Tlean 1 by the fuel supply amount Qt.

$$Qlean1=Tlean\ 1\times Qt$$

In step S9, it is determined whether the accumulated temperature-based required fuel supply amount Qtsum obtained in step S3 has reached the first lean period fuel supply amount Qlean 1. Namely, fuel supply is not performed until the accumulated temperature-based required fuel supply amount Qtsum becomes equal to the first lean period fuel supply amount Qlean 1 in FIG. 6, and the first lean period is completed when the accumulated temperature-based required fuel supply amount Qtsum becomes equal to the first lean period fuel supply amount Qlean 1 (at a time point P2 in FIG. 6). It is determined in step S9 whether Qtsum has reached Qlean 1. The determination is made based on the first lean period fuel supply amount Qlean 1 that is obtained by converting the Tlean 1 into the first lean period fuel supply amount Qlean 1, since the temperature is not decided based the length of the period but is decided based on the amount of supplied energy.

When a negative determination is made in step S9, the ECU 15 determines that the first lean period is still being performed, and ends the present routine. On the other hand, when an affirmative determination is made in step S9, the ECU 15 determines that the first lean period has been completed, and performs step S10. In step S10, the first lean period completion flag is turned ON. In step S11, a fuel supply permission flag is turned ON, afterwhich the present routine ends.

Figure 5:
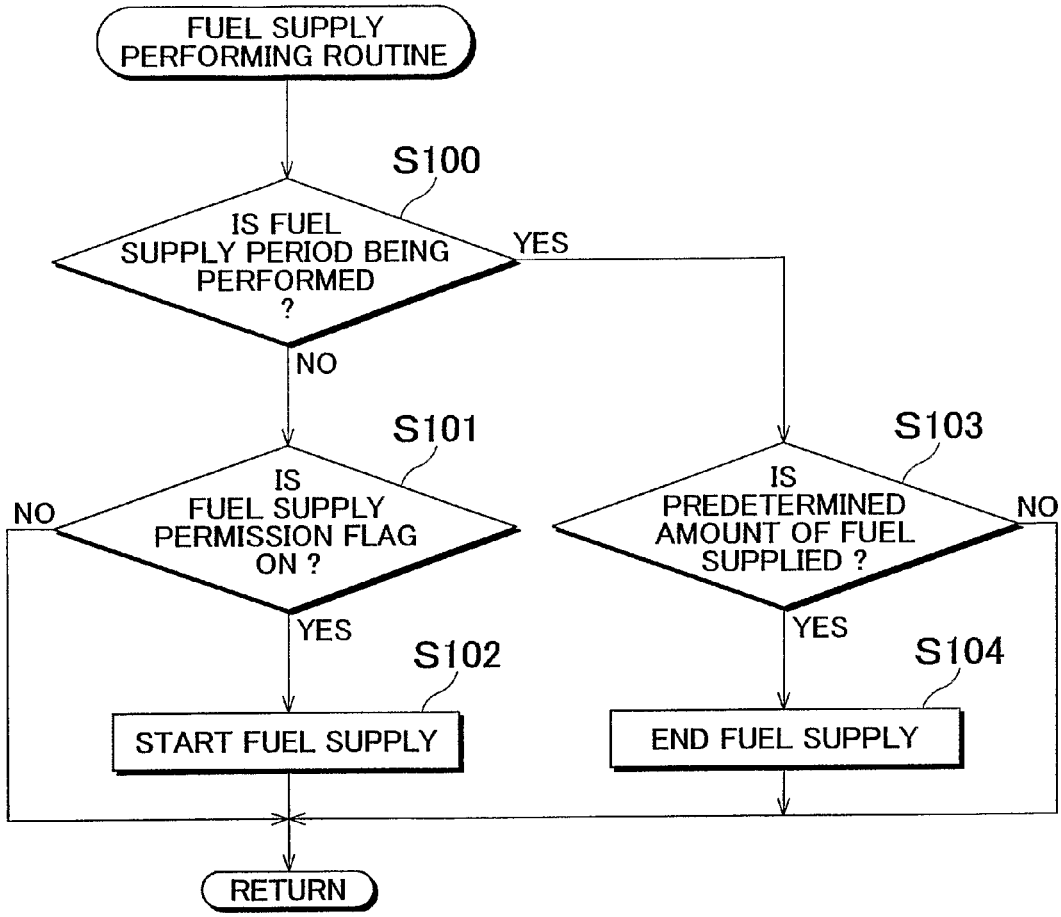
FIG. 5 is a flowchart showing a fuel supply performing routine in the first embodiment.
Figure 6:
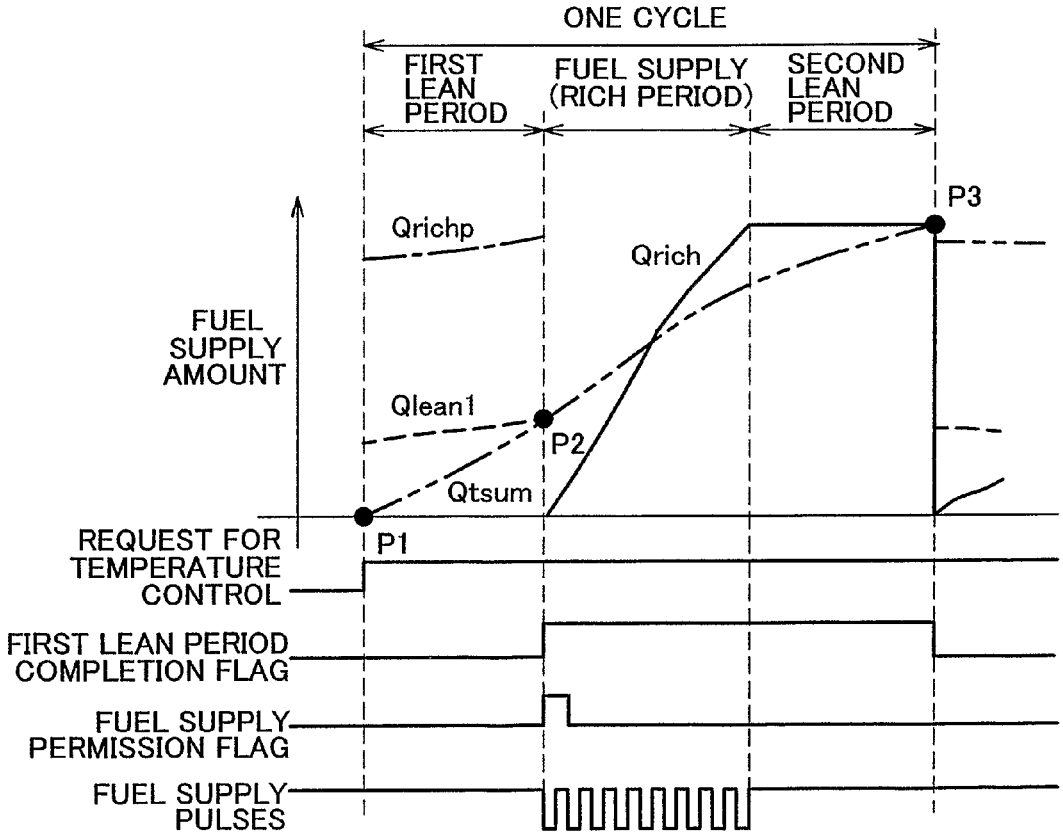
FIG. 6 is a view showing a relationship among values calculated by an ECU during one cycle, flags controlled by the ECU and a fuel supply amount in the first embodiment.

The ECU 15 repeatedly performs a fuel supply performing routine in FIG. 5 at appropriate intervals in parallel with the routine in FIG. 4. In the routine in FIG. 5, it is determined in step S100 whether the fuel supply period is being performed in which fuel is supplied from the fuel supply valve 10. When it is determined that the fuel supply period is not being performed, it is determined in step S101 whether the fuel supply permission flag is turned ON. When the fuel supply permission flag is turned ON in step S11 in FIG. 4, an affirmative determination is made in step S101 in FIG. 5. In this case, the ECU 15 allows the fuel supply valve 10 to start fuel supply in step S102 in FIG. 5. Thus, fuel supply is performed in the fuel supply period. When fuel supply is started, an affirmative determination is made in step S100 in FIG. 5, and step S103 is then performed. In step S103, the ECU 15 determines whether fuel is supplied during only the rich period (equivalent to the value used in the calculation in step S7 in FIG. 4) in the cycle. When an affirmative determination is made, step S104 is then performed in which fuel supply performed by the fuel supply valve 10 is completed, after which the routine in FIG. 5 ends. On the other hand, when a negative determination is made in step S103, step S104 is skipped.

After fuel supply is started in step S102 in FIG. 5, a negative determination is made in step S4 in the routine in FIG. 4. In this case, the ECU 15 performs step S12 in FIG. 4. In step S12, the amount of fuel supplied after the fuel supply permission flag is turned ON is obtained as the actual fuel supply amount Qrich ($mm^3$). In step S13, it is determined whether the accumulated temperature-based required fuel supply amount Qtsum is equal to or larger than the actual fuel supply amount Qrich and fuel supply from the fuel supply valve 10 has been completed. Namely, it is determined whether the ending point P3 of the second lean period in FIG. 6 has been reached. When a negative determination is made in step S13, it is determined that the cycle has not been completed yet, and the present routine ends. On the other hand, when an affirmative determination is made in step S13, each of the accumulated temperature-based required fuel supply amount Qtsum and the estimated fuel supply amount Qrichp is reset to the initial value "0" in step S14. In step S15, the first lean period completion flag is turned OFF, afterwhich the routine in FIG. 4 ends.

In the above-mentioned embodiment, the ECU 15 serves as (a) temperature-based required fuel supply amount calculating means by performing step S2; (b) estimated fuel supply amount calculating means by performing step S5, (c) fuel supply stopped period calculating means by performing step S6, and (d) fuel supply timing control means by performing step S4, steps S8 to S11, and steps S13 to S15. In the embodiment, the estimated fuel supply amount calculating means and the fuel supply stopped period calculating means calculate the fuel supply amount and the length of the fuel supply stopped period, respectively, in the pre-supply fuel supply stopped period in each fuel supply cycle.

Hereafter, second to fifth embodiments according to the invention will be described. Each of the following embodiments is obtained by modifying the process performed by the ECU 15. In each of the following embodiments, the same reference terms will be assigned to the same elements as those in the first embodiment, and the description concerning the same elements will not be made here. In each of the following flowcharts of the embodiments, the newly added steps will be indicated by heavy-line frames. Next, a second embodiment of the invention will be described with reference to FIGS. 7 to 9.

Figure 7:
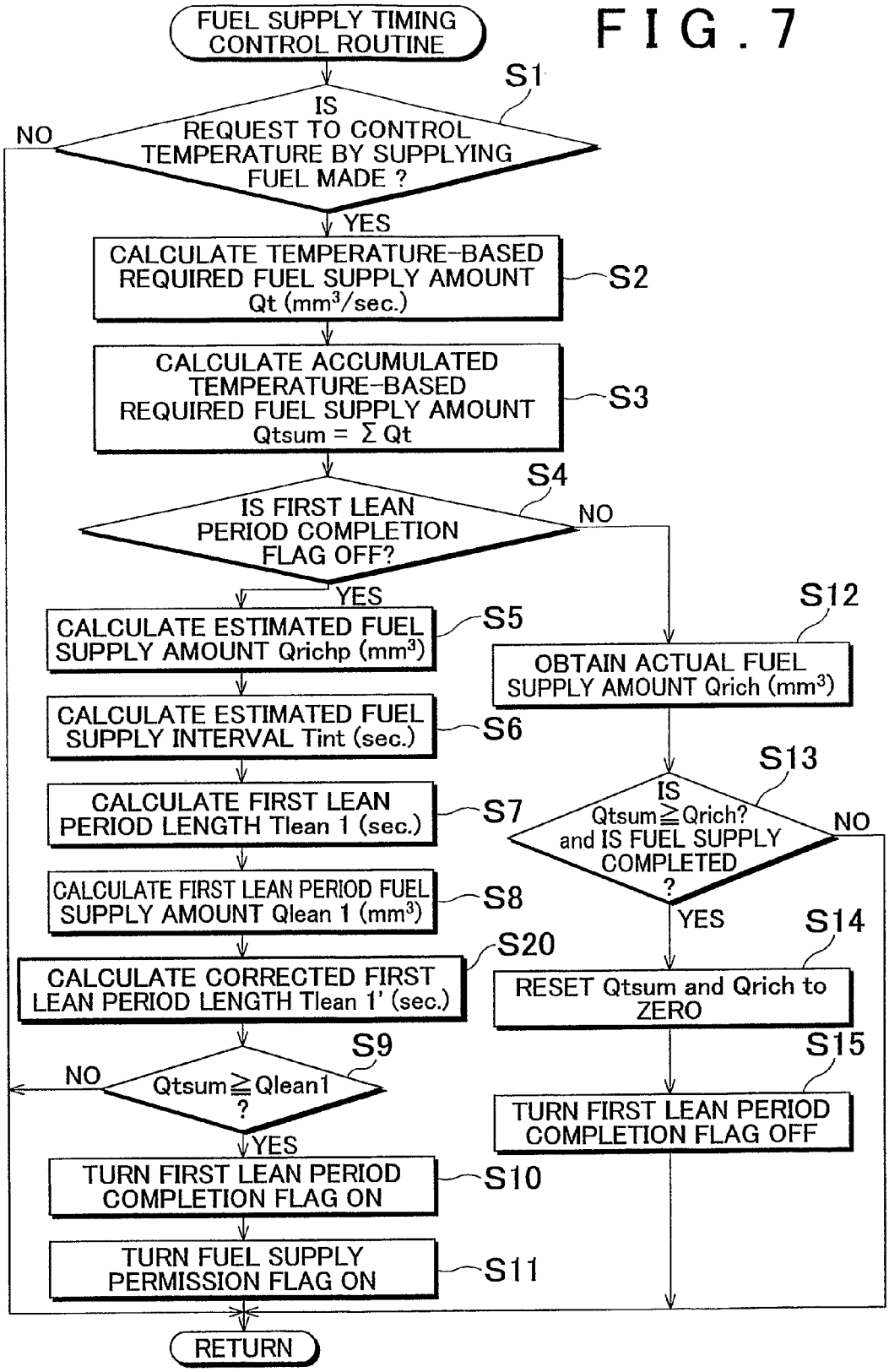
FIG. 7 is a flowchart showing a fuel supply timing control routine in a second embodiment of the invention.

FIG. 7 shows a fuel supply timing control routine in the second embodiment. In this routine, after first lean period length Tlean 1 is obtained in step S7, a corrected first lean period length Tlean 1' is calculated in step S20. In step S8, the corrected first lean period length Tlean 1' is converted into the first lean period fuel supply amount Qlean 1. The other steps are the same as those in FIG. 4 in the first embodiment. The corrected first lean period length Tlean 1' is obtained according to the following equation.

$$Tlean1' = Tlean\ 1 \times \alpha$$

Figure 8:
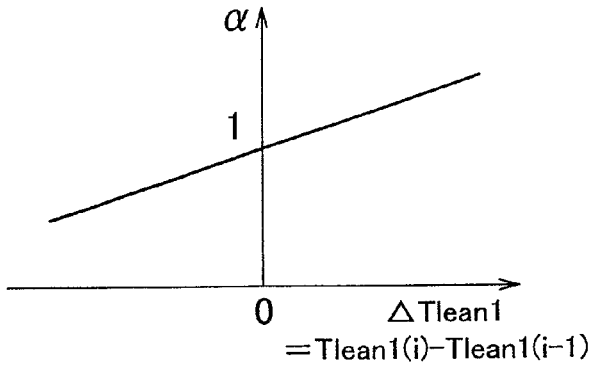
FIG. 8 is a graph showing a relationship between a coefficient used for correcting a first lean period in the routine in FIG. 7, and an amount of change in the length of the first lean period.

Here, "α" is a correction coefficient, and is obtained based on a first lean period change amount ΔTlean 1, as shown in FIG. 8. The change amount ΔTlean 1 is obtained by subtracting a first lean period length Tlean (i−1) obtained in the last routine from a first lean period length Tlean (i) calculated in the present routine. When the change amount ΔTlean 1 is "0", the correction coefficient α is "1". As the change amount ΔTlean 1 increases in the positive direction, the correction coefficient α increases.

In the second embodiment, the ECU 15 performs a fuel supply performing routine in FIG. 5 in parallel with the routine in FIG. 7.

Figure 9:
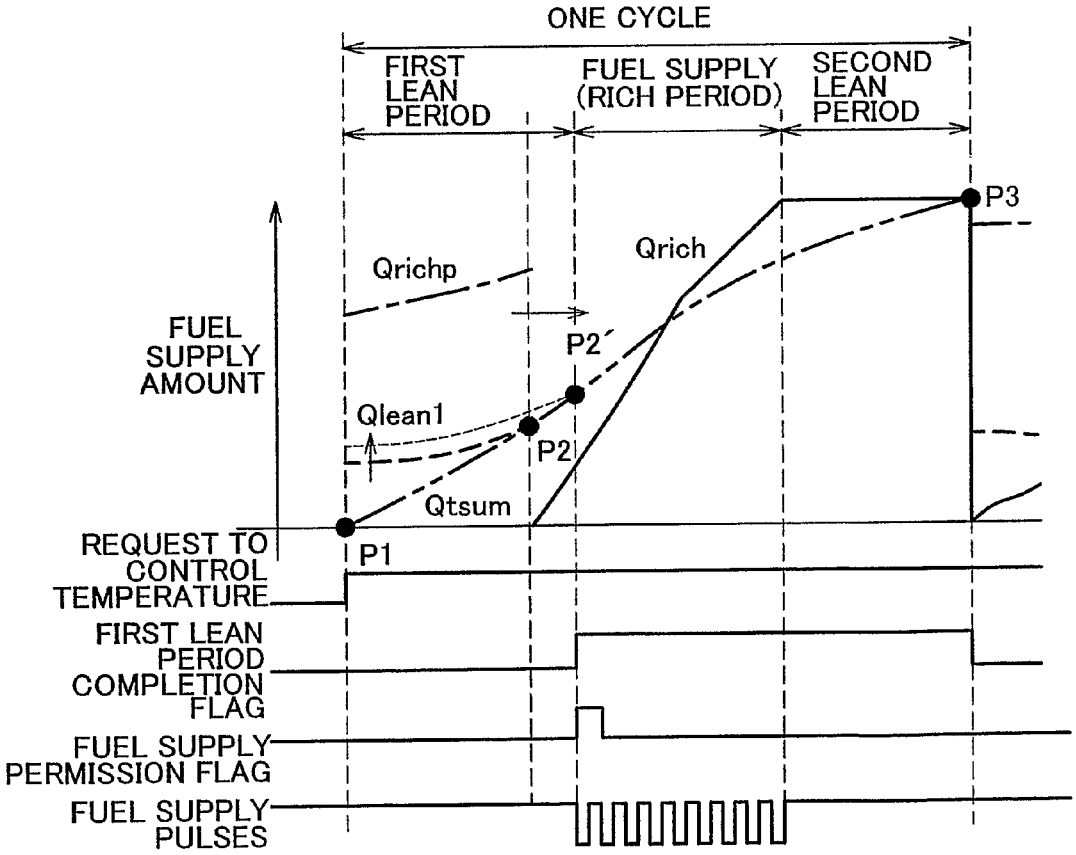
FIG. 9 is a view showing a relationship among values calculated by the ECU during one cycle, flags controlled by the ECU, and a fuel supply amount in the second embodiment.

According to the above-mentioned process, the first lean period fuel supply amount Qlean 1 is corrected based on an amount of change in the first lean period length Tlean 1 that is calculated based on the estimated fuel supply amount Qrichp and the temperature-based required fuel supply amount Qt. For example, when the vehicle is accelerating, the estimated fuel supply amount Qrichp is increased due to an increase in the intake air amount, and also the first lean period length Tlean 1 tends to be increased. In this case, as shown in FIG. 9, the first lean period fuel supply amount Qlean 1 is changed to a higher value. As a result, the time at which an affirmative determination is made in step S9 is delayed, and the time point P2 at which the accumulated temperature-based required fuel supply amount Qtsum becomes equal to the first lean period fuel supply amount Qlean 1 is changed to a time point P2' that is after the time point P2. Namely, the first lean period is extended. If the first lean period is not extended when the vehicle is accelerating, the amount of fuel actually supplied becomes larger than the fuel supply amount that is estimated when fuel supply is started, and therefore the temperature of the catalyst 8 becomes higher than the estimated catalyst temperature. However, as in the second embodiment, if the first lean period is extended, such a temperature increase is offset and fluctuation in the bed temperature can be suppressed. When the vehicle is decelerating, the first lean period length Tlean 1 is corrected so as to be reduced. Accordingly, the bed temperature of the catalyst 8 is prevented from being reduced more than necessary.

In the second embodiment, the first lean period length Tlean 1 is corrected based on the change amount thereof. However, the estimated change amount itself may be corrected based on the change amount of the estimated fuel supply amount Qrichp in the first lean period.

In the second embodiment, the ECU 15 serves as fuel the supply stopped period correcting means by performing step S20.

Figure 10:
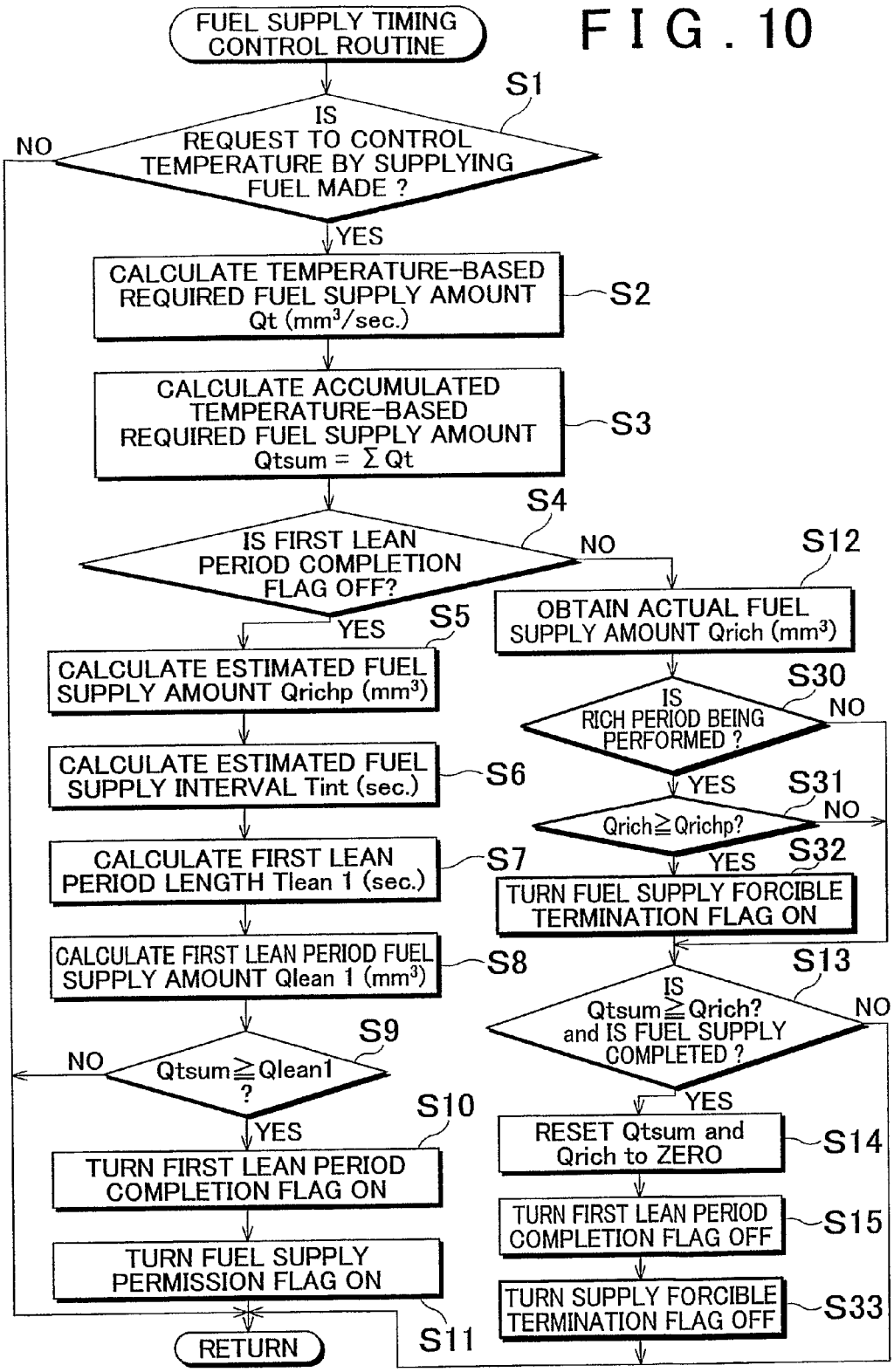
FIG. 10 is a flowchart showing a fuel supply timing control routine in a third embodiment of the invention.

Next, a third embodiment of the invention will be described with reference to FIGS. 10 to 12. FIG. 10 shows a fuel supply timing control routine in the third embodiment. This routine is the same as the routine in the first embodiment except for the process which is performed after a negative determination is made in step S4 and then step S12 is performed. Namely, in the third embodiment, after the actual fuel supply amount Qrich is obtained in step S12, it is determined in step S30 whether the rich period is being performed. When an affirmative determination is made, step S31 is then performed in which it is determined whether the actual fuel supply amount Qrich is equal to or larger than the estimated fuel supply amount Qrichp. As shown in FIG. 12, the estimated fuel supply amount Qrichp used here is equal to the estimated fuel supply amount Qrichp obtained when the first lean period is completed.

When an affirmative determination is made in step S31, a fuel supply forcible termination flag is turned ON, after which step S13 is performed. On the other hand, when a negative determination is made in step S30 or S31, step S32 is skipped and step S13 is then performed. The fuel supply forcible termination flag is turned OFF in step S33, after an affirmative determination is made in step S13 and then steps S14 and S15 are performed.

Figure 11:
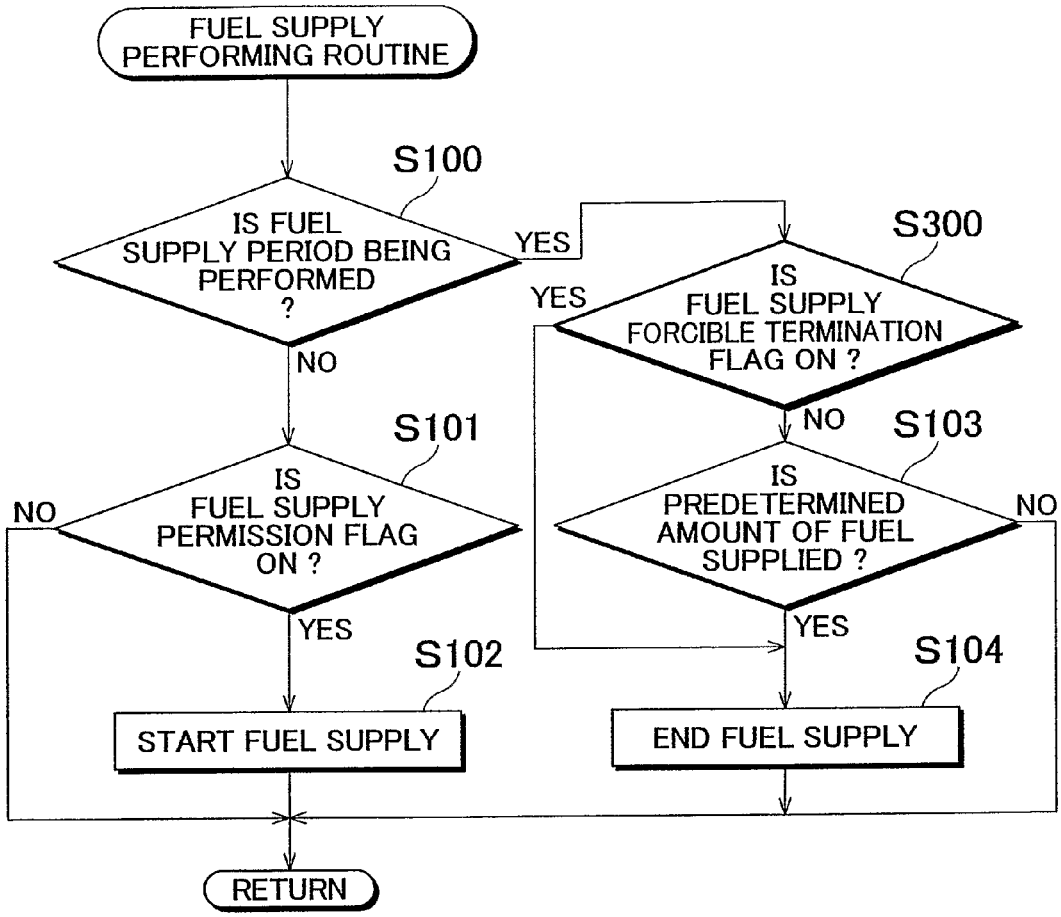
FIG. 11 is a flowchart showing a fuel supply performing routine in the third embodiment.
Figure 12:
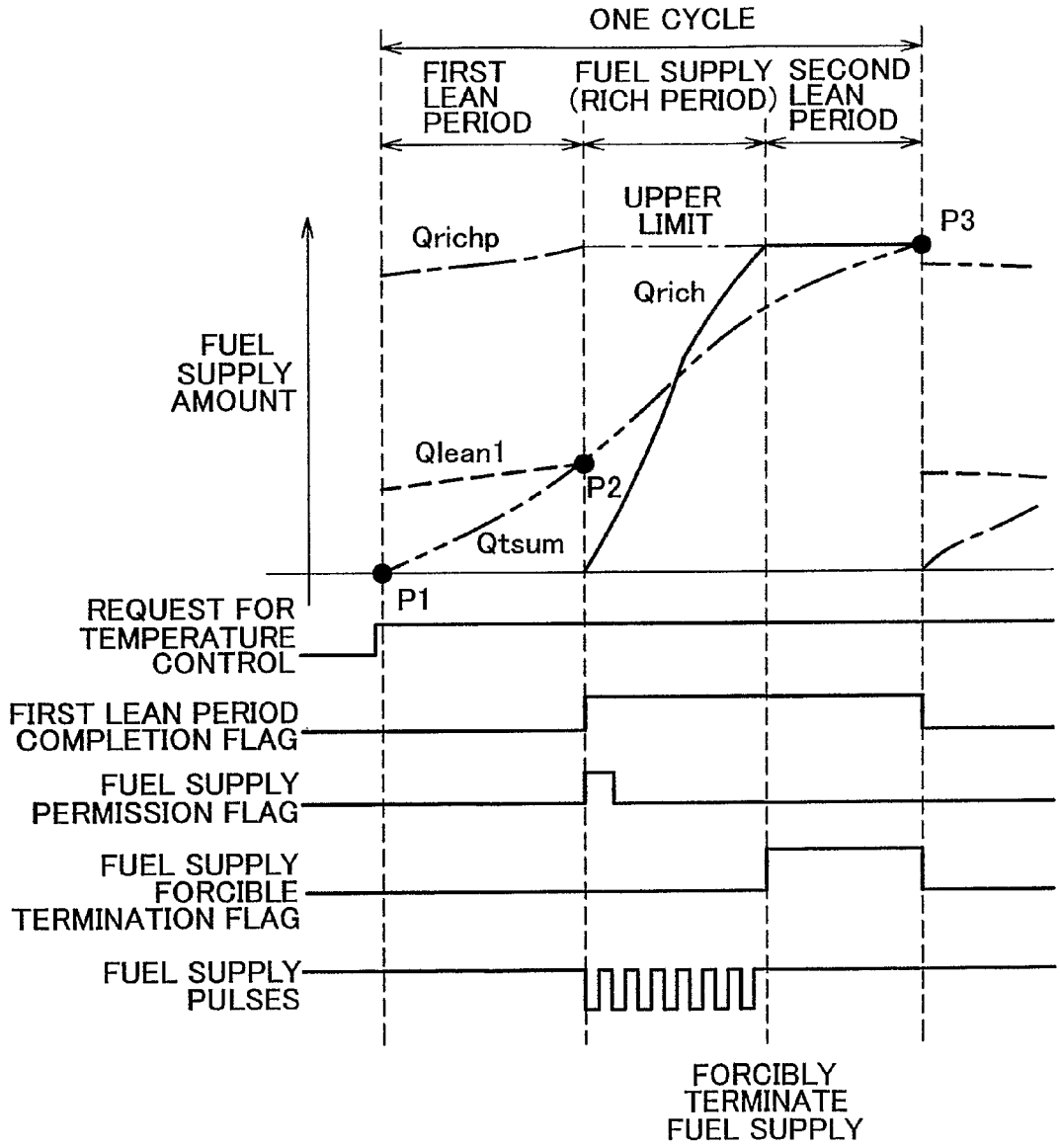
FIG. 12 is a view showing a relationship among values calculated by the ECU during one cycle, flags controlled by the ECU, and a fuel supply amount in the third embodiment.

FIG. 11 shows a fuel supply performing routine that is performed in parallel with the fuel supply timing control routine in FIG. 10. This fuel supply performing routine is the same as the fuel supply performing routine in FIG. 5 except that step S300 is provided between step S100 and step S103. Namely, when it is determined in step S100 that the fuel supply period is being performed, it is determined whether the fuel supply forcible termination flag is ON in the routine in FIG. 11. When it is determined that the fuel supply forcible termination flag is ON, step S103 is skipped and then step S104 is performed, after which fuel supply is completed.

According to the above-mentioned process, when the actual fuel supply amount Qrich reaches the estimated fuel supply amount Qrichp obtained when the first lean period is completed, the fuel supply forcible termination flag is turned ON according to the routine in FIG. 10. Then, steps S300 to step S104 in the routine in FIG. 11 are performed. As a result, as shown in FIG. 12, the actual fuel supply amount Qrich is controlled such that the estimated fuel supply amount Qrichp obtained when the first lean period is completed is the upper limit of the actual fuel supply amount Qrich. Accordingly, the fuel supply amount is prevented from exceeding the amount estimated in the first lean period. Also, the situation is prevented in which the length of first lean period becomes too short with respect to the actual fuel supply amount and therefore the temperature of the catalyst 8 becomes higher than the estimated temperature.

In the third embodiment, the ECU 15 serves as fuel supply period correcting means by performing steps S30 to S32, step S300 and step S104.

Figure 13:
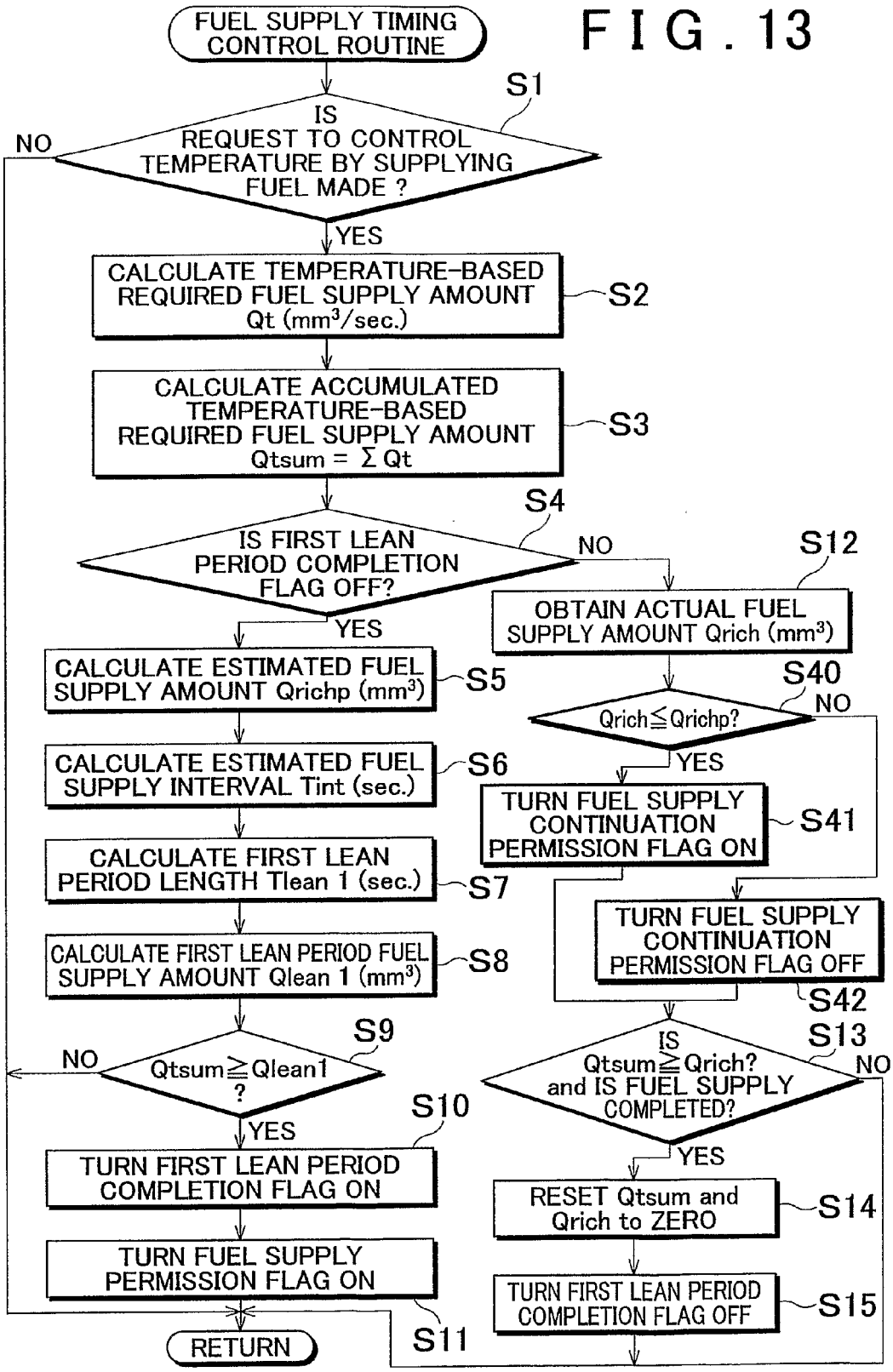
FIG. 13 is a flowchart showing a fuel supply timing control routine in a fourth embodiment of the invention.

Next, a fourth embodiment of the invention will be described with reference to FIGS. 13 to 15. FIG. 13 shows a fuel supply timing control routine in the fourth embodiment. In this routine, after the actual fuel supply amount Qrich is obtained in step S12, it is determined in step S40 whether the actual fuel supply amount Qrich is equal to or smaller than the estimated fuel supply amount Qrichp (the value obtained when the first lean period is completed). When an affirmative determination is made, a fuel supply continuation permission flag is turned ON in step S41, and step S13 is then performed. On the other hand, when it is determined in step S40 that the actual fuel supply amount Qrich has exceeded the estimated fuel supply amount Qrichp (the value obtained when the first lean period is completed), step S42 is performed in which the fuel supply continuation permission flag is turned OFF. The other steps in the fuel supply timing control routine in the fourth embodiment are the same as those in the first embodiment.

Figure 14:
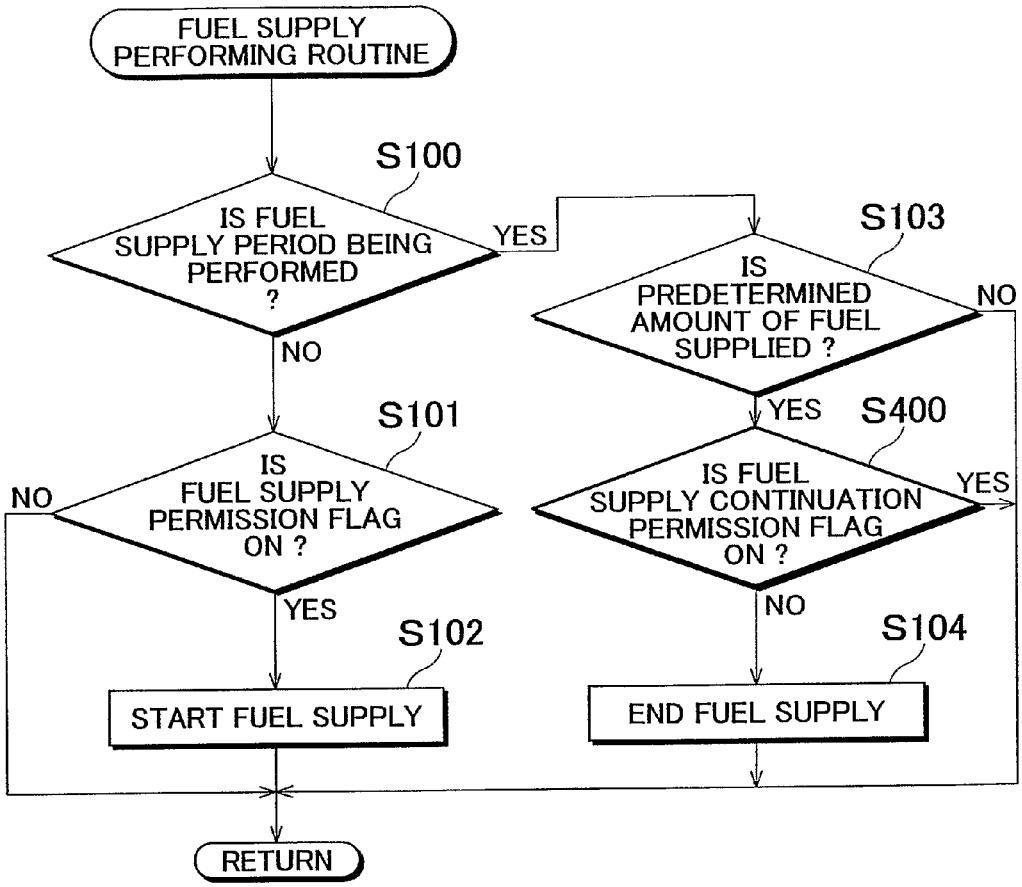
FIG. 14 is a flowchart showing a fuel supply performing routine in the fourth embodiment.
Figure 15:
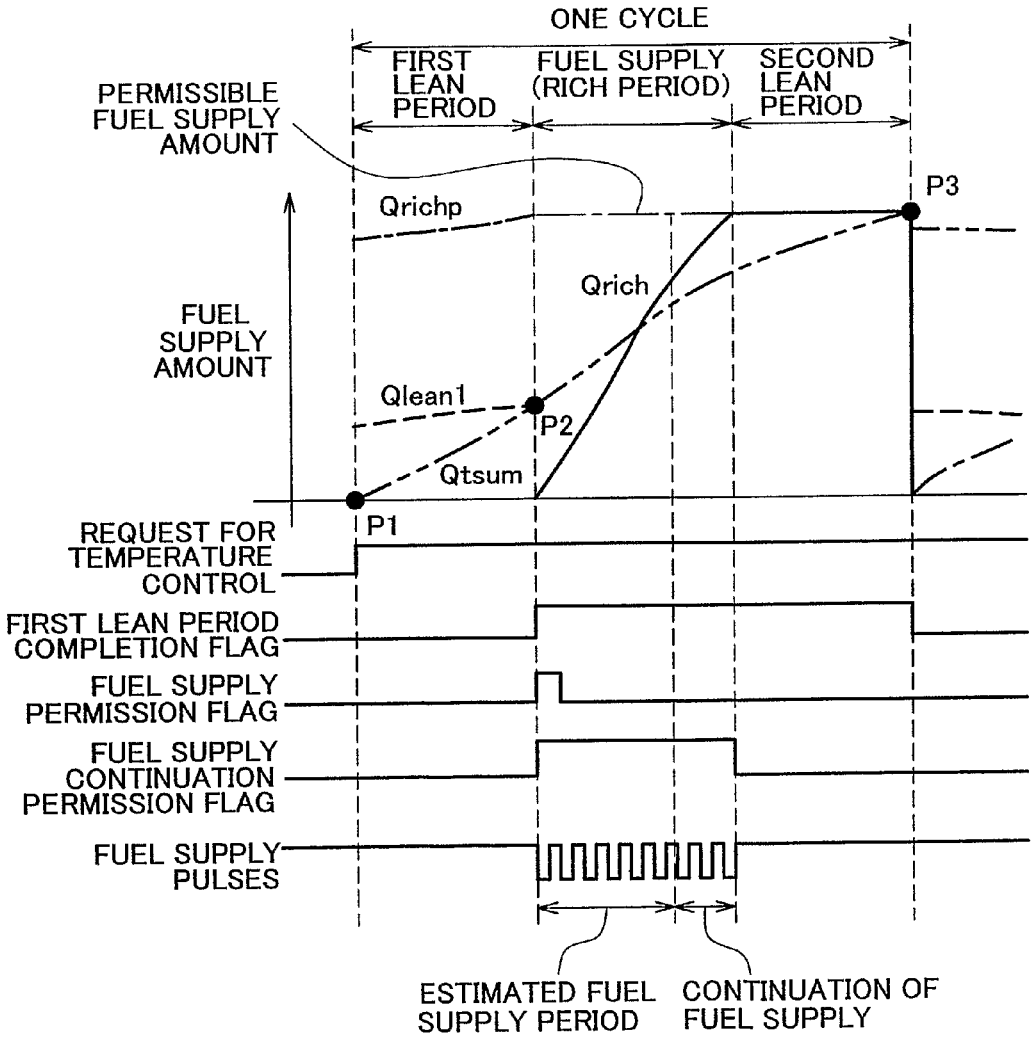
FIG. 15 is a view showing a relationship among values calculated by the ECU during one cycle, flags controlled by the ECU, and a fuel supply amount in the fourth embodiment.

FIG. 14 shows a fuel supply performing routine that is performed in parallel with the fuel supply timing control routine in FIG. 13. This routine is the same as the routine in FIG. 5 except that step S400 is provided between step S103 and step S104. Namely, even when it is determined in step S103 that the fuel is supplied during the entire rich period in the cycle, it is determined in step S400 whether the fuel supply continuation permission flag is ON, instead of performing step S104 immediately after an affirmative determination is made in step S103. When it is determined in step S400 that the fuel supply continuation permission flag is ON, step S104 is skipped. On the other hand, when it is determined in step S400 that the fuel supply continuation permission flag is OFF, fuel supply is completed in step S104.

According to the above-mentioned process, even after the first lean period is completed and the fuel is supplied during the entire predetermined rich period, if the actual fuel supply amount Qrich has not reached the estimated fuel supply amount Qrichp obtained when the first lean period is completed, the fuel supply continuation permission flag is kept ON and fuel supply is continued. Accordingly, as shown in FIG. 15, the estimated fuel supply amount Qrichp obtained when the lean period is completed is used as a permissible fuel supply amount. The fuel supply period is extended until the actual fuel supply amount Qrich reaches the permissible fuel supply amount. Accordingly, even when an increasing rate of the actual fuel supply amount Qrich is reduced due to a change in the operating state (e.g., a load) of the engine 1 in the fuel supply period, the fuel supply period is extended based on the reduction amount of the increasing rate, and a sufficient amount of fuel required for the S recovery can be supplied. Namely, when a larger amount of fuel may be supplied based on the state of the catalyst 8, the fuel supply period is extended, and the S recovery can proceed.

In the fourth embodiment, the ECU 15 serves as the fuel supply period correcting means by performing steps S40 to S42, step S400 and step S104.

Figure 16:
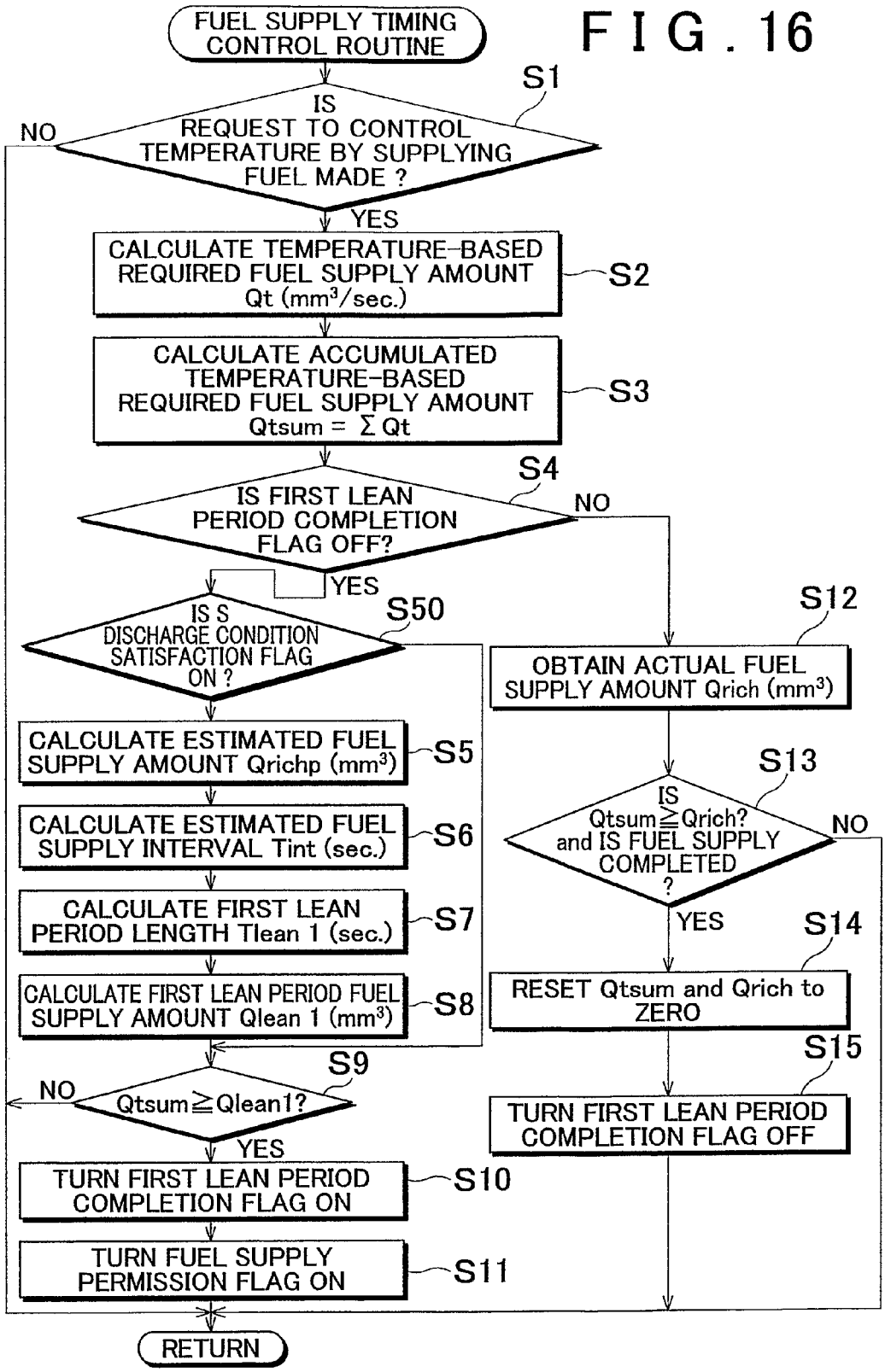
FIG. 16 is a flowchart showing a fuel supply timing control routine in a fifth embodiment of the invention.
Figure 17:
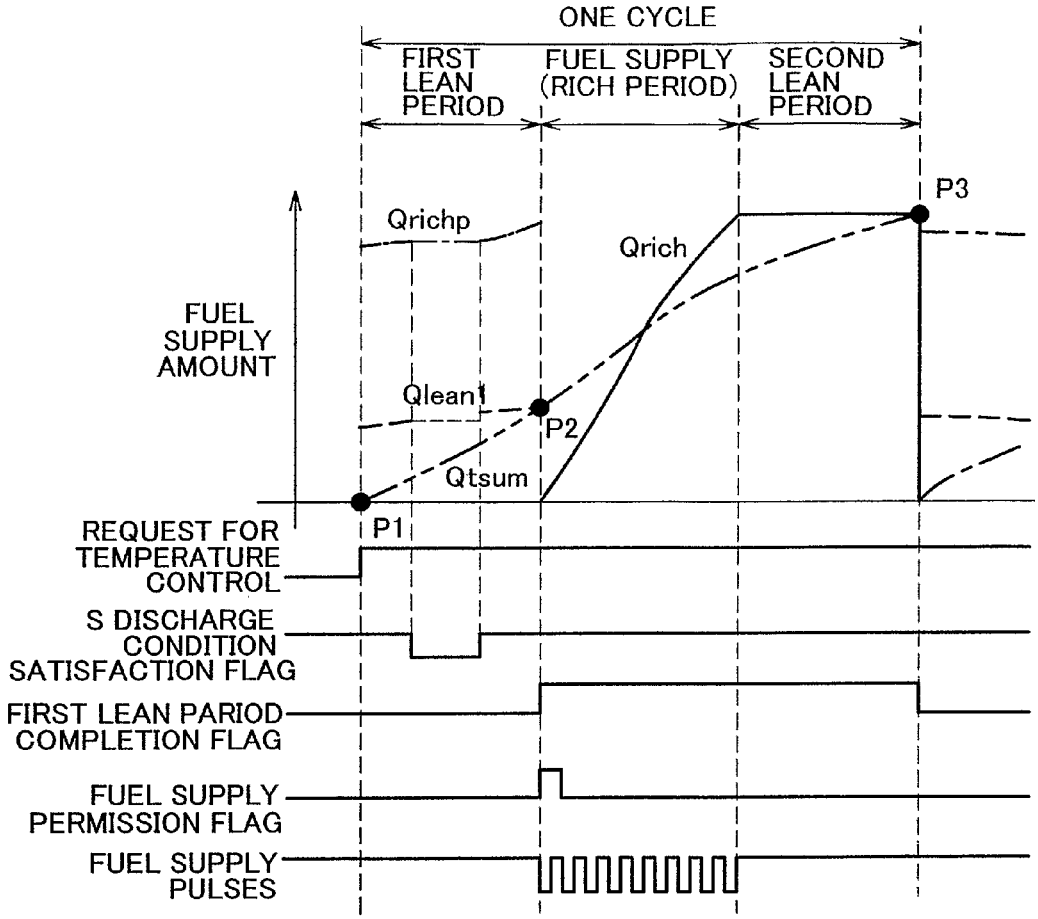
FIG. 17 is a flowchart showing a fuel supply performing routine in the fifth embodiment.

Next, a fifth embodiment of the invention will be described with reference to FIGS. 16 and 17. FIG. 16 shows a fuel supply timing control routine in the fifth embodiment. This routine is the same as the routine in FIG. 4 except that step S50 is provided between step S4 and step S5. Namely, when it is determined in step S4 that the first lean period completion flag is OFF, it is then determined in step S50 whether a sulfur component discharge condition satisfaction flag (hereinafter, referred to as a "S discharge condition satisfaction flag") is ON. The ECU 15 controls the S discharge condition satisfaction flag by using another routine. The S discharge condition satisfaction flag is turned ON, when the S recovery for the catalyst 8 can be performed. For example, when the air-fuel ratio needs to be controlled to be a lean air-fuel ratio for some reason, for example, if the amount of fuel adhering to an exhaust manifold forming a part of the exhaust passage 4 becomes excessive, or if clogging occurs at the front end of the catalyst 8, the S discharge condition satisfaction flag is kept OFF since the operating state is not appropriate for performing the S recovery.

When it is determined in step S50 that the S discharge condition satisfaction flag is ON, step S5 is then performed. On the other hand, when it is determined in step S50 that the S discharge condition satisfaction flag is OFF, steps S5 to S8 are skipped, and step S9 is then performed. Namely, as shown in FIG. 17, when the S discharge condition satisfaction flag is turned OFF during the first lean period, updating of the estimated fuel supply amount Qrichp and updating of the first lean period fuel supply amount Qlean 1 obtained based on the estimated fuel supply amount Qrichp are stopped, and Qrichp and Qlean 1 are maintained at the values obtained immediately before the S discharge condition satisfaction flag is turned OFF. When the S discharge condition satisfaction flag is turned ON, updating of the first lean period fuel supply amount Qlean 1 is restarted.

In the fifth embodiment, the ECU 15 performs the fuel supply performing routine in FIG. 5 in parallel with the routine in FIG. 16. Accordingly, even when the S discharge condition satisfaction flag is turned OFF during the first lean period, fuel supply for maintaining the temperature of the catalyst 8 is not performed. When the S discharge condition satisfaction flag is OFF, usually, short-cycled fuel supply is performed in order to maintain the temperature of the catalyst 8 (hereinafter, referred to as "temperature maintaining fuel supply"). However, in the case where such temperature maintaining fuel supply is performed, when the S discharge condition satisfaction flag is turned ON again, the time period until the fuel supply is performed becomes long. Therefore, the temperature maintaining fuel supply is forcibly prohibited here. However, when the first lean period is completed while the S discharge condition satisfaction flag is kept OFF, fuel supply is started. Since the S discharge condition satisfaction flag is OFF, the fuel supply amount in this case is smaller than the fuel supply amount during the S recovery, and is limited to the value necessary for maintaining the temperature of the catalyst 8.

According to the above-mentioned process, while the S discharge condition satisfaction flag is OFF during the first lean period, the first lean period fuel supply amount Qlean 1 is not updated, and is maintained at a constant value. Accordingly, the first lean period in this case becomes shorter than the first lean period in the case where the amount of fuel that is necessary to maintain the temperature is supplied in response to turning-OFF of the S discharge condition satisfaction flag. As a result, it is possible to more promptly perform fuel supply for the S recovery in response to turning-ON of the S discharge condition satisfaction flag.

In the fifth embodiment, the ECU 15 serves as temperature maintaining fuel supply control means by performing step S4, step S50 and steps S9 to S11.

In each of the first to fifth embodiments, the description has been made concerning the example in which the temperature of the catalyst 8 is controlled to the target temperature in the S recovery. However, the invention is not limited to these embodiments, and the invention can be applied to various cases where the temperature of the catalyst needs to be controlled to a target temperature in order to achieve an object of some sort. For example, the invention can be applied to temperature control that is performed when a filtering function of a filter, which is provided in order to collect the particulate matter contained in the exhaust gas, is recovered by burning the particulate matter.

Fuel supply for controlling the temperature is not limited to the fuel supply from the fuel supply valve provided in the exhaust passage upstream of the catalyst. For example, post injection using the fuel injection valve 16, that is, injection, which is performed in order to add fuel to the exhaust gas and which is performed after the main injection for injecting fuel in the cylinder 2, may be controlled according to the invention. The fuel supply amount may be controlled in consideration of adhesion and evaporation of the fuel in the exhaust passage 4, and a time lag between when fuel is supplied and when the supplied fuel reaches the catalyst 8. The temperature of the catalyst 8 is decided based on the fuel supply amount and the purification efficiency of the catalyst 8. Therefore, the temperature may be controlled in consideration of the purification efficiency.

Figure 18:
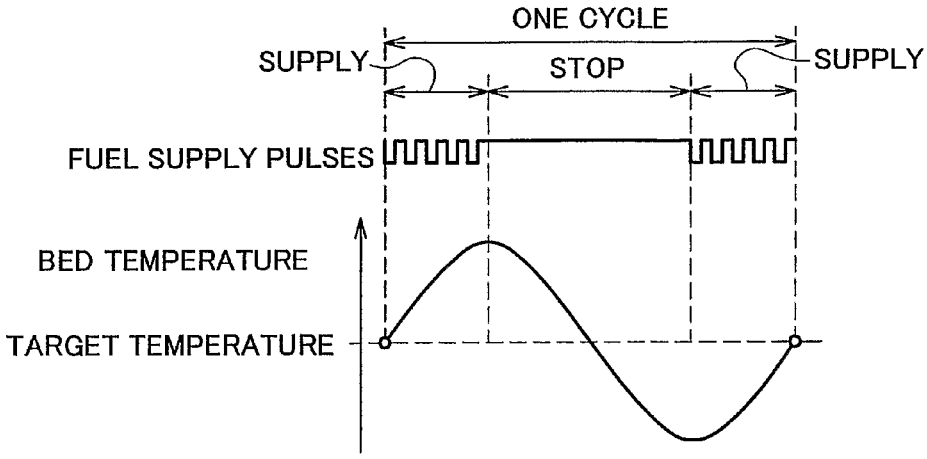
FIG. 18 is a view showing a modified example in which a cycle is configured such that a fuel supply period is divided into two fuel supply periods and a fuel supply stopped period is set between the two fuel supply periods obtained by the division.

In addition, in each of the above-mentioned embodiments, the fuel supply stopped period is divided into two periods, and the fuel supply period is set between the two fuel supply stopped periods obtained by the division. However, as shown in FIG. 18, the fuel supply period may be divided into two periods, and the one cycle may be formed such that the fuel supply stopped period is set between the two fuel supply periods obtained by the division.

What is claimed is:

1. A fuel supply control method for an exhaust gas control apparatus for an internal combustion engine, comprising:

operating a fuel supply portion that supplies fuel to a portion upstream of an exhaust gas control portion that purifies exhaust gas released from the internal combustion engine such that a cycle formed by combining a fuel supply period in which fuel is supplied from the fuel supply portion and a fuel supply stopped period in which fuel is not supplied is repeatedly performed, and controlling an arrangement of the fuel supply period and the fuel supply stopped period such that a temperature of the exhaust gas control portion at each of a starting point and an ending point of each cycle is equal to a target temperature, wherein the fuel supply period: i) comprises a plurality of fuel pulses, ii) begins at a first point in time when the temperature of the exhaust gas control portion is below the target temperature, and iii) ends at a second point in time, following the first point in time, when the temperature of the exhaust gas control portion is above the target temperature, wherein the temperature of the exhaust gas control portion continuously increases from the first point in time to the second point in time.

2. The fuel supply control method according to claim 1, wherein the fuel supply portion is operated such that one of the fuel supply period and the fuel supply stopped period is divided into two periods and the other of the fuel supply period and the fuel supply stopped period is set between the two periods obtained by the division.

3. The fuel supply control method according to claim 1, wherein the exhaust gas control portion is a NOx storage reduction catalyst.

4. The fuel supply control method according to claim 1, wherein a length of one of the repeatedly performed cycles is different than a length of an other of the repeatedly performed cycles.

5. The fuel supply control method according to claim 1, wherein the fuel supply stopped period is at least as long as a pulse of a previous fuel supply period or a next fuel supply period.

6. An exhaust gas control apparatus for an internal combustion engine, comprising:

an exhaust gas control portion provided in an exhaust passage of an internal combustion engine;

a fuel supply portion that supplies fuel to a portion upstream of the exhaust gas control portion; and a fuel supply control portion that operates the fuel supply portion such that a cycle formed by combining a fuel supply period in which fuel is supplied from the fuel supply portion and a fuel supply stopped period in which fuel is not supplied is repeatedly performed in order to control a temperature of the exhaust gas control portion to a target temperature, wherein the fuel supply period: i) comprises a plurality of fuel pulses, ii) begins at a first point in time when the temperature of the exhaust gas control portion is below the target temperature, and iii) ends at a second point in time, following the first point in time, when the temperature of the exhaust gas control portion is above the target temperature, wherein the temperature of the exhaust gas control portion continuously increases from the first point in time to the second point in time, and the fuel supply control portion comprises:

a temperature-based required fuel supply amount calculating portion that calculates a fuel supply amount that is required to control the temperature of the exhaust gas control portion to the target temperature;

an estimated fuel supply amount calculating portion that calculates a fuel supply amount that is required to maintain an air-fuel ratio in the exhaust gas control portion at a target air-fuel ratio during a predetermined period;

a fuel supply stopped period calculating portion that calculates a length of the cycle based on the fuel supply amount calculated by the temperature-based required fuel supply amount calculating portion and the fuel supply amount calculated by the estimated fuel supply amount calculating portion, and that calculates a length of the fuel supply stopped period in the cycle by subtracting a length of the predetermined period, as a length of the fuel supply period, from the calculated length of the cycle; and a fuel supply timing control portion that controls whether fuel supply by the fuel supply portion is performed in each cycle such that a half of the calculated fuel supply stopped period is set, as a pre-supply fuel supply stopped period, before the fuel supply period.

7. The exhaust gas control apparatus according to claim 6, wherein the fuel supply control portion further comprises a fuel supply period correcting portion that changes the fuel supply period from the predetermined period such that an amount of fuel actually supplied during the fuel supply period is equal to the fuel supply amount obtained by the estimated fuel supply amount calculation portion in the pre-supply stopped period.

8. The exhaust gas control apparatus according to claim 6, wherein the exhaust gas control portion is a NOx storage reduction catalyst.

9. The exhaust gas control apparatus according to claim 6, wherein a length of one of the repeatedly performed cycles is different than a length of an other of the repeatedly performed cycles.

10. The exhaust gas control apparatus according to claim 6, wherein the fuel supply stopped period is at least as long as a pulse of a previous fuel supply period or a next fuel supply period.

11. The exhaust gas control apparatus according to claim 6, wherein the fuel supply control portion further comprises a fuel supply stopped period correcting portion that corrects a length of the pre-supply fuel supply stopped period based on a change in a calculation result obtained by the estimated fuel supply amount calculating portion or the fuel supply stopped period calculating portion in the pre-supply fuel supply stopped period.

12. The exhaust gas control apparatus according to claim 11, wherein the fuel supply control portion further comprises a fuel supply period correcting portion that changes the fuel supply period from the predetermined period such that an amount of fuel actually supplied during the fuel supply period is equal to the fuel supply amount obtained by the estimated fuel supply amount calculating portion in the pre-supply fuel supply stopped period.

13. The exhaust gas control apparatus according to claim 12, wherein the fuel supply control portion further comprises a temperature maintaining fuel supply control portion (1) that determines whether an operating state of the internal combustion engine is appropriate for a recovery process for the exhaust gas control portion that is performed by supplying fuel; (2) that prohibits fuel supply that is performed by the fuel supply portion in order to maintain the temperature of the exhaust gas control portion, when determining that the operating state is not appropriate for the recovery process in the pre-supply fuel supply stopped period; and (3) that permits fuel supply for maintaining the temperature of the exhaust gas control portion after the pre-supply fuel supply stopped period is completed.

14. An exhaust gas control apparatus for an internal combustion engine, comprising:

an exhaust gas control portion provided in an exhaust passage of an internal combustion engine;

a fuel supply portion that supplies fuel to a portion upstream of the exhaust gas control portion; and a fuel supply control portion that operates the fuel supply portion such that a cycle formed by combining a fuel supply period in which fuel is supplied from the fuel supply portion and a fuel supply stopped period in which fuel is not supplied is repeatedly performed in order to control a temperature of the exhaust gas control portion to a target temperature, wherein the fuel supply period: i) comprises a plurality of fuel pulses, ii) begins at a first point in time when the temperature of the exhaust gas control portion is below the target temperature, and iii) ends at a second point in time, following the first point in time, when the temperature of the exhaust gas control portion is above the target temperature, wherein the temperature of the exhaust gas control portion continuously increases from the first point in time to the second point in time, and the fuel supply control portion comprises:

a temperature-based required fuel supply amount calculating portion that calculates a fuel supply amount that is required to control the temperature of the exhaust gas control portion to the target temperature;

an estimated fuel supply amount calculating portion that calculates a fuel supply amount that is required to maintain an air-fuel ratio in the exhaust gas control portion at a target air-fuel ratio during a predetermined period;

a fuel supply stopped period calculating portion that calculates a length of the cycle based on the fuel supply amount calculated by the temperature-based required fuel supply amount calculating portion and the fuel supply amount calculated by the estimated fuel supply amount calculating portion, and that calculates a length of the fuel supply stopped period in the cycle by subtracting a length of the predetermined period, as a length of the fuel supply period, from the calculated length of the cycle; and a fuel supply timing control portion that controls whether fuel supply by the fuel supply portion is performed in each cycle such that a half of the fuel supply period is set, as a pre-supply-stop fuel supply period, before the fuel supply stopped period.

15. The exhaust gas control apparatus according to claim 14, wherein the exhaust gas control portion is a NOx storage reduction catalyst.

16. The exhaust gas control apparatus according to claim 14, wherein a length of one of the repeatedly performed cycles is different than a length of an other of the repeatedly performed cycles.

17. The exhaust gas control apparatus according to claim 14, wherein the fuel supply stopped period is at least as long as a pulse of a previous fuel supply period or a next fuel supply period.

* * * * *